US012102153B2

(12) United States Patent
Paterlini et al.

(10) Patent No.: US 12,102,153 B2
(45) Date of Patent: Oct. 1, 2024

(54) MACHINE FOR MANUFACTURING BOXERS

(71) Applicant: SANTONI S.P.A., Brescia (IT)

(72) Inventors: Stefano Paterlini, Brescia (IT); Andrea Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 314 days.

(21) Appl. No.: 17/620,880

(22) PCT Filed: Jun. 18, 2020

(86) PCT No.: PCT/IB2020/055730
§ 371 (c)(1),
(2) Date: Dec. 20, 2021

(87) PCT Pub. No.: WO2020/255030
PCT Pub. Date: Dec. 24, 2020

(65) Prior Publication Data

US 2022/0312880 A1 Oct. 6, 2022

(30) Foreign Application Priority Data

Jun. 19, 2019 (IT) ..... 102019000009507

(51) Int. Cl.
*A41H 42/00* (2006.01)
*A41B 9/02* (2006.01)
*D05B 33/00* (2006.01)

(52) U.S. Cl.
CPC ..... *A41H 42/00* (2013.01); *A41B 9/02* (2013.01); *D05B 33/00* (2013.01)

(58) Field of Classification Search
CPC ..... A41H 42/00; A41H 43/0228; A41H 43/0235; A41B 9/02; A41B 9/00;
(Continued)

(56) References Cited

U.S. PATENT DOCUMENTS 3,037,368 A * 6/1962 Isenhour ..... A41B 11/14 66/177
4,101,982 A * 7/1978 Muller ..... A41B 11/14 2/408

(Continued)

FOREIGN PATENT DOCUMENTS

JP 2001049505 A * 2/2001
JP 2010131058 A * 6/2010

(Continued)

OTHER PUBLICATIONS

Search Report dated Sep. 7, 2020 in corresponding International Application No. PCT/IB2020/055730, 3 pages.

(Continued)

*Primary Examiner* — Ismael Izaguirre
(74) *Attorney, Agent, or Firm* — MH2 TECHNOLOGY LAW GROUP LLP

(57) ABSTRACT

A machine for manufacturing boxers starting from a first and a second tubular fabric includes a separating station configured for separating a fabric element from the second tubular fabric. The machine includes a handling station configured for defining an operating configuration in which the first tubular fabric defines an operating area, and a moving device configured for placing the fabric element inside the operating area. The machine further comprises a sewing station configured for receiving the incoming tubular fabric and the fabric element placed in the operating area and for sewing longitudinal edges the fabric element to edge segments of an end of the first tubular fabric so as to obtain a boxer.

15 Claims, 11 Drawing Sheets

(58) Field of Classification Search
CPC ..... A41B 9/004; A41B 11/00; A41B 11/01; D05B 33/00; D05B 35/06
See application file for complete search history.

(56) References Cited

U.S. PATENT DOCUMENTS

| | | | | | |
|---|---|---|---|---|---|
| 4,539,924 | A * | 9/1985 | Bell, Jr. | D05B 23/007 | 112/475.12 |
| 5,207,166 | A * | 5/1993 | Eichhorn | A41B 11/14 | 112/155 |
| 5,349,913 | A * | 9/1994 | Schramayr | D05B 41/00 | 112/63 |
| 6,098,557 | A | 8/2000 | Couillard et al. | | |
| 6,779,472 | B1 * | 8/2004 | Green | D05B 23/009 | 112/475.12 |
| 2015/0296891 | A1 | 10/2015 | Blibech | | |

FOREIGN PATENT DOCUMENTS

| | | | | |
|---|---|---|---|---|
| JP | 2016117968 | A * | 6/2016 | |
| WO | WO-2007020669 | A1 * | 2/2007 | D05B 23/007 |
| WO | 2014060909 | A1 | 4/2014 | |
| WO | 2016038509 | A1 | 3/2016 | |

OTHER PUBLICATIONS

Written Opinion dated Sep. 7, 2020 in corresponding International Application No. PCT/IB2020/055730, 6 pages.

* cited by examiner

MACHINE FOR MANUFACTURING BOXERS

CROSS-REFERENCE TO RELATED APPLICATIONS

This application is a U.S. National Stage application of PCT/IB2020/055730 filed Jun. 18, 2020, pending, which claims priority to Italian Application No. 102019000009507 filed Jun. 19, 2019, the entire disclosures of which are hereby incorporated by reference.

FIELD OF THE INVENTION

The present invention relates to a machine for manufacturing men's underwear such as boxers, and to a method for manufacturing men's underwear such as boxers.

The invention can be advantageously used in the field of manufacturing men's underwear, in particular for manufacturing boxers.

PRIOR ART

In the field of manufacturing men's underwear, it is known about methods for manufacturing boxers. Prior art methods involve manually manufacturing boxers starting from fabric pieces to be sewn to one another.

Since prior art methods are performed manually, they do not ensure a high accuracy and reliable repeatability. As a results, boxers manufactured with prior art methods are not without drawbacks.

Moreover, the quality of manually manufactured boxers depends much on the experience and expertise of the operator who has to sew the fabric pieces so as to obtain boxers. As a result, according to prior art methods, a different operator can affect the quality of boxers thus manufactured.

Moreover, the methods in which boxers are manufactured manually are long and therefore inefficient.

AIMS OF THE INVENTION

The aim of the present invention is therefore to solve at least one of the drawbacks and/or limitations of prior art solutions.

A first aim of the present invention is to provide a machine that enables to automate the manufacturing of men's underwear such as boxers.

Another aim of the present invention is to provide a machine that is able to make the manufacturing of men's underwear such as boxers repeatable.

An additional aim of the present invention is to provide a machine that enables to obtain men's underwear such as boxers with a high and constant quality.

A further aim of the present invention is to provide a machine that allows to implement an efficient method for manufacturing men's underwear such as boxers.

Another aim of the present invention is to provide a machine that is able to speed up the manufacturing of men's underwear such as boxers.

An aim of the present invention is to provide a machine that is able to reduce the manufacturing costs for men's underwear such as boxers.

An additional aim of the present invention is to disclose a method that is able to make the manufacturing of men's underwear such as boxers repeatable.

The additional aims described above in relation to the machine for manufacturing men's underwear such as boxers are shared by the method for manufacturing men's underwear such as boxers.

These and other aims, which shall be more apparent from the following description, are basically achieved by a machine for manufacturing men's underwear such as boxers, by a use of the machine for manufacturing men's underwear such as boxers and by a method for manufacturing men's underwear such as boxers, in accordance with one or more of the appended claims and/or with one or more of the following aspects.

SUMMARY

Some aspects of the invention are described below.

In a $1^{st}$ aspect it is provided for a machine for manufacturing men's underwear such as boxers, comprising:

- a first loading station configured for allowing loading of at least one tubular fabric or a stack of tubular fabrics, the tubular fabric being of the type having a first end and a second end opposed to one another, between which a fabric coat delimiting a tubular duct develops, each end exhibiting an edge delimiting a hollow access port apt to enable access to the tubular duct, the edge of the first end comprising a first edge portion and a second edge portion that are adjacent to one another and cooperate so as to delimit the hollow access port of the first end, the first edge portion and the second edge portion comprising a respective middle segment designed to be sewn, and respective end segments opposed to the respective middle segment,
- a handling station configured for handling the tubular fabric and for defining, in at least one operating condition, an intermediate operating area, optionally the intermediate operating area being defined between the first edge portion and the second edge portion of the tubular fabric,
- a second loading station configured for allowing loading of at least one fabric element or of at least one further tubular fabric (second tubular fabric) from which at least a fabric element can be separated,
- a moving device configured for moving the fabric element, downstream from the second loading station, as far as the handling station and configured for placing the fabric element in an operating position, defined at said intermediate operating area,
- a sewing station configured the incoming tubular fabric and the fabric element arranged with respect to the tubular fabric in said operating position, the sewing station being configured for sewing the first edge portion and the second edge portion to respective longitudinal edges of the fabric element so as to obtain a boxer.

In a $2^{nd}$ aspect in accordance with the $1^{st}$ aspect, the handling station comprises at least a take-up device configured for catching the tubular fabric at said first edge portion and/or at said second edge portion, and for handling said first edge portion.

In a $3^{rd}$ aspect in accordance with the $1^{st}$ or $2^{nd}$ aspect, the handling station comprises:

- at least a first take-up device configured for catching the tubular fabric on said first edge portion and handling said first edge portion,
- at least a second take-up device configured for catching the tubular fabric on said second edge portion and handling said second edge portion.

In a $4^{th}$ aspect in accordance with the $3^{rd}$ aspect, the intermediate operating area is defined, in at least one operating configuration, between the first take-up device and the second take-up device.

In a $5^{th}$ aspect in accordance with any one of the aspects from $1^{st}$ to the $4^{th}$, in the operating position of the fabric element a first longitudinal edge of the fabric element and the middle segment of said first edge portion at least partially overlap or face each other or are arranged near one another, and a second longitudinal edge of the fabric element, opposed to said longitudinal edge, and the middle segment of said second edge portion at least partially overlap or face each other or are arranged near one another.

In a $6^{th}$ aspect in accordance with any one of the aspects from the $1^{st}$ to the $5^{th}$, the sewing station is configured for sewing the first longitudinal edge of the fabric element to the middle segment of the first edge portion of the first end of the tubular fabric so as to make the fabric element integral with the first edge portion, and it is further configured for sewing the second longitudinal edge of the fabric element to the middle segment of the second edge portion of the first end of the tubular fabric so as to make the fabric element integral with said second edge portion.

In a $7^{th}$ aspect in accordance with any one of the aspects from the $1^{st}$ to the $6^{th}$, the fabric element sewn to the tubular fabric is engaged to the first edge portion and to the second edge portion of the first end of the tubular fabric so as to obtain men's underwear such as a pair of boxers, a first transversal edge and a second transversal edge of the fabric element, which are transversal to the longitudinal edges of the fabric element, opposed to one another and adjacent to respective end lengths of the first edge portion and of the second edge portion, delimiting at least partially, together with the respective adjacent end lengths, respective hollow portions of the men's underwear item designed to act as a guide for the lower limbs of a user of the men's underwear item, the second end of the tubular fabric being designed to surround, with the men's underwear item in use, the user's torso.

In an $8^{th}$ aspect in accordance with any one of the aspects from the $3^{rd}$ to the $7^{th}$, at least one of the first take-up device and the second take-up device is configured for operating between a catching position in which it can catch the respective edge portion, and an operating position in which it defines, together with the other one of the first take-up device and the second take-up device, said intermediate operating area.

In a $9^{th}$ aspect in accordance with the $8^{th}$ aspect, said at least one of the first take-up device and the second take-up device is movable with respect to the other one of the first take-up device and the second take-up device so as to switch from the catching position to the operating position.

In a $10^{th}$ aspect in accordance with any one of the aspects from the $3^{th}$ to the $9^{th}$, the handling station is configured for further defining, before said operating configuration, a catching configuration in which the first take-up device and the second take-up device take respective operating positions in which they catch the first edge portion and the second edge portion, respectively.

In an $11^{th}$ aspect in accordance with the $10^{th}$ aspect, in said catching configuration the first edge portion is at a first height and the second edge portion is below the first edge portion at a second height that is smaller than the first height.

In a $12^{th}$ aspect in accordance with the $11^{th}$ aspect, the second take-up device is configured for rotating with respect to the first take-up device so as to shift from the catching position to the operating position in order to shift the second edge portion to the first height at which the second edge portion takes a pre-established operating position in which it faces the first edge portion.

In a $13^{th}$ aspect in accordance with any one of the aspects from the $1^{st}$ to the $12^{th}$, the machine comprises a cutting station configured for creating at least one of a first cut or vent on the tubular fabric on the middle segment of said first edge portion, and a second cut or vent on the tubular fabric on the middle segment of said second edge portion, said at least one cut or vent defining a first piece and a second piece on the respective middle segment.

In a $14^{th}$ aspect in accordance with any one of the aspects from the $1^{st}$ to the $13^{th}$, the machine comprises a cutting station configured for creating a first cut or vent on the tubular fabric on the middle segment of said first edge portion, and a second cut or vent on the tubular fabric on the middle segment of said second edge portion, each cut or vent defining a first piece and a second piece on the respective middle segment.

In a $15^{th}$ aspect in accordance with the $14^{th}$ aspect, the cutting station comprises a cutting element for creating the first cut or vent on the tubular fabric on the middle segment of said first edge portion, and the second cut or vent on the tubular fabric on the middle segment of said second edge portion.

In a $16^{th}$ aspect in accordance with the $15^{th}$ aspect, the cutting element comprises at least one of: a pair of scissors, a blade, a cutter, a guillotine.

In a $17^{th}$ aspect in accordance with the $15^{th}$ or $16^{th}$ aspect, the machine further comprises a control unit operatively connected to the first take-up device, to the second take-up device and to the cutting element, and configured for:

- driving the first take-up device to catch the tubular fabric on said first edge portion,
- driving the second take-up device to catch the tubular fabric on said second edge portion,
- after the first take-up device has caught the tubular fabric, driving the cutting element to create the first cut or vent on the tubular fabric in the middle segment of said first edge portion, e.g. at a first point in time,
- after the second take-up device has caught the tubular fabric, driving the cutting element to create the second cut or vent on the tubular fabric in the middle segment of said second edge portion, e.g. at a second point in time.

In an $18^{th}$ aspect in accordance with the $17^{th}$ aspect, the control unit if configured for managing a time sequence for creating the first cut or vent and the second cut or vent, according to which the second point in time is after the first point in time.

In a $19^{th}$ aspect in accordance with any one of the aspects from the $13^{th}$ to the $18^{th}$, the cutting station comprises:

- a cutting device comprising a cutting element and a supporting element carrying the cutting element, and
- a guiding mechanism configured for moving the supporting element and thus the cutting element carried by the latter, approaching the first take-up device and/or the second take-up device, e.g. along a vertical direction.

In a $20^{th}$ aspect in accordance with the $19^{th}$ aspect, the cutting device further comprises a motor element engaged to the supporting element and configured for moving the supporting element and thus the cutting element carried by the latter, between the first take-up device and the second take-up device, or vice versa, e.g. along a vertical direction.

In a $21^{st}$ aspect in accordance with any one of the aspects from the $3^{rd}$ to the $20^{th}$, the machine further comprises a control unit operatively connected to the first take-up device and to the second take-up device, the control unit being configured for:

driving the first take-up device to spread, in operating conditions of the machine, the first piece and the second piece of the middle segment of the first edge portion, e.g. so as to place the first piece and the second piece of the middle segment of the first edge portion along a basically straight line, driving the second take-up device to spread, in operating conditions of the machine, the first piece and the second piece of the middle segment of the second edge portion, e.g. so as to place the first piece and the second piece of the middle segment of the second edge portion along a basically straight line.

In a 22$^{nd}$ aspect in accordance with the 21$^{st}$ aspect, the control unit is configured for driving said take-up devices so as to place the pieces of said edge portions along basically straight lines in order to define said intermediate operating area.

In a 23$^{rd}$ aspect in accordance with the 21$^{st}$ or 22$^{nd}$ aspect, the control unit is further configured for driving the first take-up device and/or the second take-up device so as to place, in operating conditions of the machine, the first edge portion and the second edge portion in a pre-established operating position in which they face each other.

In a 24$^{th}$ aspect in accordance with any one of the aspects from the 1$^{st}$ to the 23$^{rd}$, the machine further comprises a spreading station configured for spreading, in operating conditions of the machine, at least partially the tubular fabric so as to stretch and/or tension it.

In a 25$^{th}$ aspect in accordance with the 24$^{th}$ aspect, the spreading station is arranged, with reference to a forward path of the tubular fabric in the machine, downstream from the first loading station.

In a 26$^{th}$ aspect in accordance with the 24$^{th}$ or 25$^{th}$ aspect, the spreading station is arranged between the first loading station and a cutting station.

In a 27$^{th}$ aspect in accordance with the 24$^{th}$ or 25$^{th}$ or 26$^{th}$ aspect, the machine comprises a frame, the spreading station being movably engaged to the frame so as to be able to slide to and from the cutting station.

In a 28$^{th}$ aspect in accordance with any one of the aspects from the 24$^{th}$ to the 27$^{th}$, the spreading station comprises two spreading bars configured for being distanced and approached one to the other and further configured for being introduced, in operating conditions of the machine, into the tubular duct of the tubular fabric and for being removed from the tubular duct.

In a 29$^{th}$ aspect in accordance with any one of the aspects from the 1$^{st}$ to the 28$^{th}$, the machine further comprises a first pick-up station configured for picking up at least one tubular fabric from the first loading station.

In a 30$^{th}$ aspect in accordance with the 29$^{th}$ aspect, the first pick-up station is arranged downstream from the first loading station and is configured for picking up a first tubular fabric at a time from the first loading station.

In a 31$^{st}$ aspect in accordance with the 28$^{th}$ or 29$^{th}$ or 30$^{th}$ aspect, the machine further comprises a control unit operatively connected to the first take-up device, to the second take-up device and to the spreading bars, and configured for:

after the first pick-up device has picked up the tubular fabric, introducing at least partially the spreading bars into the tubular duct, spreading the spreading bars so as to stretch and/or tension the tubular fabric, driving the first take-up device and the second take-up device so that they catch the first edge portion and the second edge portion, respectively, of the tubular fabric, after the first cut or vent has been created on the first edge portion and the second cut or vent has been created on the second edge portion, removing the spreading bars from the tubular duct so as to disengage them from the tubular fabric.

In a 32$^{nd}$ aspect in accordance with any one of the aspects from the 1$^{st}$ to the 29$^{th}$, the machine further comprises a second pick-up station configured for picking up at least one fabric element, e.g. from a stack of fabric elements, or a further tubular fabric (second tubular fabric) from which at least at least one fabric element can be separated, from the second loading station.

In a 33$^{rd}$ aspect in accordance with the 32$^{nd}$ aspect, the second pick-up station is arranged downstream from the second loading station and is configured for picking up a second tubular fabric or a fabric element at a time from the second loading station.

In a 34$^{th}$ aspect in accordance with any one of the aspects from the 1$^{st}$ to the 33$^{rd}$, the tubular fabric is of the pre-cut or pre-vented type and having at least one of a first cut or vent on the middle segment of said first edge portion, and a second cut or vent on the middle segment of said second edge portion, each cut or vent defining a first piece and a second piece on the respective middle segment, the first loading station being configured for allowing loading of at least one tubular fabric of the pre-cut or pre-vented type, or of a stack of tubular fabrics of the pre-cut or pre-vented type, and the first take-up device being configured for catching the first piece and the second piece of said first edge portion, and the second take-up device being configured for catching the first piece and the second piece of said second edge portion.

In a 35$^{th}$ aspect in accordance with any one of the aspects from the 1$^{st}$ to the 34$^{th}$, the machine further comprises a frame and least one moving mechanism acting upon the handling station and configured for moving at least partially the handling station with respect to the frame.

In a 36$^{th}$ aspect in accordance with the 35$^{th}$ aspect, the machine comprises a control unit operatively connected to said at least one moving mechanism so as to drive the at least partial movement of the handling station with respect to the frame.

In a 37$^{th}$ aspect in accordance with the 35$^{th}$ or 36$^{th}$ aspect, said at least one moving mechanism is configured for moving, in operating conditions of the machine, the first take-up device and/or the second take-up device so as to push the tubular fabric forward for at least a part of a forward path of the tubular fabric in the machine.

In a 38$^{th}$ aspect in accordance with any one of the aspects from the 3$^{rd}$ to the 37$^{th}$, the first take-up device is configured for spreading said first edge portion.

In a 39$^{th}$ aspect in accordance with any one of the aspects from the 3$^{rd}$ to the 38$^{th}$, the first take-up device comprises a first gripper and a second gripper configured for catching the first piece and the second piece, respectively, of the middle segment of said first edge portion.

In a 40$^{th}$ aspect in accordance with the 39$^{th}$ aspect, at least one of the first gripper and the second gripper of the first take-up device can be moved with respect to the other gripper so as to spread the first piece and the second piece of the middle segment of said first edge portion.

In a 41$^{st}$ aspect in accordance with any one of the aspects from the 3$^{rd}$ to the 40$^{th}$, the second take-up device is configured for spreading said second edge portion.

In a 42$^{nd}$ aspect in accordance with any one of the aspects from the 3$^{rd}$ to the 41$^{st}$, the second take-up device comprises a first gripper and a second gripper configured for catching the first piece and the second piece, respectively, of the middle segment of said second edge portion.

In a 43rd aspect in accordance with the 42nd aspect, at least one of the first gripper and the second gripper of the second take-up device can be moved with respect to the other gripper so as to spread the first piece and the second piece of the middle segment of said second edge portion.

In a 44th aspect in accordance with any one of the aspects from the 35th to the 43rd, the machine comprises a control unit operatively connected to said at least one moving mechanism and configured for driving the movement of a first of pliers and/or of a second gripper of the first take-up device independently from the movement of a first gripper and/or of a second gripper of the second take-up device.

In a 45th aspect in accordance with the 44th aspect, the control unit is configured for driving the movement of the first gripper and/or of the second gripper of the first take-up device and the movement of the first gripper and/or of the second gripper according to a specific time sequence.

In a 46th aspect in accordance with any one of the aspects from the 3rd to the 45th, the machine comprises a first rail and a second rail, each rail being at least partially parallel to the sewing station, the first take-up device being operatively connected to the first rail so as to be able to slide longitudinally along the first rail approaching and getting away from the sewing station, and the second take-up device being operatively connected to the second rail so as to be able to slide longitudinally along the second rail approaching and getting away from the sewing station.

In a 47th aspect in accordance with the 46th aspect, at least one of the first rail and the second rail is configured for being moved, optionally by rotation, so as to be able to take an operating position in which the first rail and the second rail, and thus the first take-up device and the second take-up device engaged thereto, develop on opposed sides with respect to a base of the sewing station.

In a 48th aspect in accordance with any one of the aspects from the 3rd to the 47th, the machine comprises a first guide and a second guide, the first take-up device being operatively connected to the first guide so as to be able to slide longitudinally along the first guide transversally with respect to the sewing station, and the second take-up device being operatively connected to the second guide so as to be able to slide longitudinally along the second guide transversally with respect to the sewing station.

In a 49th aspect in accordance with the 48th aspect, the first guide and the second guide develop transversally to the first rail and to the second rail.

In a 50th aspect in accordance with any one of the aspects from the 1st to the 49th, the second loading station is configured for allowing loading of a further tubular fabric (second tubular fabric) or of a stack of further tubular fabrics (second tubular fabrics) from which at least one fabric element can be separated.

In a 51st aspect in accordance with the 50th aspect, the machine further comprises a separating station arranged downstream from the second loading station, the separating station being configured for separating, e.g. by means of one or more cutting operations, at least one fabric element from the further tubular fabric, the fabric element being basically a strip or length of the further tubular fabric.

In a 52nd aspect in accordance with the 50th or 51st aspect, said tubular fabric (first tubular fabric) and the fabric element or the further tubular fabric (second tubular fabric) are made of the same fabric and/or are manufactured using the same type of knitting machine and/or by means of the same circular knitting machine for knitted or hosiery items.

In a 53rd aspect in accordance with the 51st or 52nd aspect, the separating station comprises a positioning device configured for positioning said further tubular fabric picked up from the second pick-up station, and a cutting element configured for cutting the further tubular fabric so as to separate a fabric element from the further tubular fabric.

In a 54th aspect in accordance with the 53rd aspect, the cutting element comprises at least one of: a blade, a rotating blade, a pair of scissors, a cutter, a guillotine.

In a 55th aspect in accordance with the 53rd or 54th aspect, the positioning device comprises a pair of spreading bars configured for spreading the second tubular fabric so as to stretch and/or tension it.

In a 56th aspect in accordance with the 53rd or 54th or 55th aspect, the positioning device comprises a blocking element configured for blocking said further tubular fabric.

In a 57th aspect in accordance with the 56th aspect, the blocking element comprises a pressure roll configured for exerting a pressure onto a portion of said further tubular fabric.

In a 58th aspect in accordance with the 55th or 56th or 57th aspect, the machine comprises a control unit operatively connected to the spreading bars, to the blocking element and to the cutting element, and configured for:

- positioning the spreading bars inside the tubular duct of said further tubular fabric,
- driving the spreading bars so as to spread said further tubular fabric so as to stretch and/or tension it,
- driving the blocking element so as to block said further tubular fabric,
- driving the cutting element so as to execute at least one cutting operation on said further tubular fabric, thus separating at least one fabric element from the further tubular fabric.

In a 59th aspect in accordance with the 58th, the control unit is configured for:

- if the further tubular fabric is intact, i.e. it has not undergone any separating operation yet, driving the cutting element so as to execute a first cutting operation aiming at opening the coat of said further tubular fabric, and to execute a second cutting operating aiming at removing a fabric element,
- if the further tubular fabric has already undergone a separating operation, driving the cutting element so as to execute a cutting operation aiming at removing a fabric element.

In a 60th aspect in accordance with any one of the aspects from the 1st to the 59th, the sewing station comprises one sewing head configured for sewing on a first sewing area that is close and beside the first operating area, and configured for further sewing on a second sewing area that is close and beside the second operating area.

In a 61st aspect in accordance with any one of the aspects from the 1st to the 60th, the sewing station comprises a sewing machine comprising:

- a base equipped with a first side and with a second side opposed one to the other, the base defining a first operating area and a second operating area that are opposed to the sides of the base,
- a sewing head configured for sewing on a first sewing area that is close and beside the first operating area, and configured for further sewing on a second sewing area that is close and beside the second operating area.

In a 62nd aspect in accordance with the 61st aspect, said at least one moving mechanism is configured for moving at least partially the handling station with respect to the frame so as to push, in operating conditions of the machine, the first take-up device and/or the second take-up device and thus the tubular fabric along a forward path of the tubular fabric through the machine.

In a 63$^{rd}$ aspect in accordance with the 61$^{st}$ or 62$^{nd}$ aspect, said at least one moving mechanism is configured for moving the first take-up device and/or the second take-up device in a sequence of operating positions defined around the base of the sewing machine so as to move, in operating conditions of the machine, said tubular fabric in a sequence of operating positions defined around the base of the sewing machine.

In a 64$^{th}$ aspect in accordance with the 61$^{st}$ or 62$^{nd}$ or 63$^{rd}$ aspect, the machine further comprises a control unit operatively connected to said at least one moving mechanism and to the moving device, and configured for:

driving said at least one moving mechanism to move the first take-up device and/or the second take-up device in a sequence of operating positions defined around the base of the sewing machine so as to move, in operating conditions of the machine, said tubular fabric in a sequence of operating positions defined around the base of the sewing machine, driving the moving device to move, in operating conditions of the machine, said fabric element in a sequence of operating positions defined around the base of the sewing machine, managing the movement of the tubular fabric and of the fabric element according to a positioning relation between the sequence of operating positions of the first take-up device and/or of the second take-up device and the sequence of operating positions of the moving device, said positioning relation being such as to allow the sewing machine to sew the first longitudinal edge of the fabric element to the first edge portion of the first end of the tubular fabric and the second longitudinal edge of the fabric element to the second edge portion of the first end of the tubular fabric, driving the sewing machine to sew, on one of the first sewing area and the second sewing area, the first longitudinal edge of the fabric element to the first piece and to the second piece of the middle segment of the first edge portion of the first end of the tubular fabric, and to sew, on the other one of the first sewing area and the second sewing area, the second longitudinal edge of the fabric element to the first piece and to the second piece of the middle segment of the second edge portion of the first end of the tubular fabric.

In a 65$^{th}$ aspect in accordance with the 64$^{th}$ aspect, the first longitudinal edge of the fabric element is sewn to the first piece and to the second piece of the middle segment of the first edge portion of the first end of the tubular fabric, and the second longitudinal edge of the fabric element is sewn to the first piece and to the second piece of the middle segment of the second edge portion of the first end of the tubular fabric, on respective sewing lines that are at least partially rectilinear and/or at least partially parallel, optionally basically rectilinear and/or basically parallel.

In a 66$^{th}$ aspect in accordance with any one of the aspects from the 3$^{rd}$ to the 65$^{th}$, the machine comprises a first moving mechanism operatively connected to the first take-up device, and a second moving mechanism operatively connected to the second take-up device, the first moving mechanism and the second moving mechanism being configured for moving the first take-up device and the second take-up device, respectively, in a sequence of operating positions defined around the base of the sewing machine so as to move, in operating conditions of the machine, said tubular fabric in a sequence of operating positions defined around the base of the sewing machine.

In a 67$^{th}$ aspect in accordance with the 66$^{th}$ aspect, the first moving mechanism carries the first rail, optionally the first take-up device comprising the first rail, the first rail comprising an arm along which the first gripper and the second gripper of the first take-up device can shift.

In a 68$^{th}$ aspect in accordance with the 67$^{th}$ aspect, the second moving mechanism carries the second rail, optionally the second take-up device comprising the second rail, the second rail comprising a crossbar along which the first gripper and the second gripper of the second take-up device can shift.

In a 69$^{th}$ aspect in accordance with any one of the aspects from the 3$^{rd}$ to the 68$^{th}$, the machine further comprises a third moving mechanism or tiler configured for moving the second take-up device so as to shift the first gripper and the second gripper of the second take-up device to the same height as the first gripper and the second gripper of the first take-up device.

In a 70$^{th}$ aspect in accordance with the 69$^{th}$ aspect, the second take-up device comprises the second rail, the third moving mechanism or tilter acting upon the second rail and being configured for causing a rotation of the second rail of an angular width of 90° to 270°, optionally of 150° to 210°, in particular basically of 180°.

In a 71$^{st}$ aspect in accordance with the 69$^{th}$ or 70$^{th}$ aspect, the third moving mechanism or tilter is configured for tilting the first gripper and the second gripper of the second take-up device by making a rotation along an arc of circumference or semi-circumference having an angular width basically of 180°.

In a 72$^{nd}$ aspect in accordance with the 69$^{th}$ or 70$^{th}$ or 71$^{st}$ aspect, the third moving mechanism or tilter comprises a rack and a toothed wheel operatively connected to the second rail and configured for rotating with respect to the rack, the rotation of the toothed wheel with respect to the rack causing the shift of the second rail, and thus of the first gripper and of the second gripper of the second take-up device, to the height of the first gripper and of the second gripper of the first take-up device, so as to define the intermediate operating area.

In a 73$^{rd}$ aspect in accordance with any one of the aspects from the 69$^{th}$ to the 72$^{nd}$, the machine comprises a control unit operatively connected to the third moving mechanism or tilter and configured for driving the third moving mechanism or tilter so as to move the second take-up device in order to shift the first gripper and the second gripper of the second take-up device to the same height as the first gripper and the second gripper of the first take-up device.

In a 74$^{th}$ aspect in accordance with the 73$^{th}$ aspect, the control unit is configured for, before the movement of the second take-up device by the third moving mechanism or tilter and if the first take-up device and the second take-up device are in a configuration in which the second take-up device lies below the first take-up device and/or the first take-up device and the second take-up device are vertically aligned, displacing the first take-up device and the second take-up device.

In a 75$^{th}$ aspect in accordance with any one of the aspects from the 66$^{th}$ or the 74$^{th}$, the machine further comprises a control unit operatively connected to the first moving mechanism, to the second moving mechanism and to the moving device, and configured for:

driving the first moving mechanism to move, in operating conditions of the machine, said first edge portion in a sequence of operating positions defined around the base of the sewing machine, driving the second moving mechanism to move, in operating conditions of the machine, said second edge portion in a sequence of operating positions defined around the base of the sewing machine, driving the moving device to move, in operating conditions of the machine, said fabric element in a sequence of operating positions defined around the base of the sewing machine, synchronously handling the movement of said first edge portion, of said second edge portion and said fabric element so as to position, at the same instant, the instantaneous position of the tubular fabric and of the fabric element corresponding to one another, corresponding instantaneous positions of the tubular fabric and of the fabric element meaning that the fabric element is arranged in said intermediate operating area between said first edge portion and said second edge.

In a 76$^{th}$ aspect in accordance with any one of the aspects from the 1$^{st}$ to the 75$^{th}$, the moving device comprises a slide configured for moving the fabric element along a fabric element path defined around the base of the sewing machine in a sequence of operating positions apt to allow the first longitudinal edge of the fabric element to be sewn to the middle segment of the first edge portion of the first end of the tubular fabric, and apt to allow the second longitudinal edge of the fabric element to be sewn to the middle segment of the second edge portion of the first end of the tubular fabric, optionally the slide being configured for moving also the tubular fabric around the base of the sewing machine.

In a 77$^{th}$ aspect in accordance with the 76$^{th}$ aspect, the slide is configured for moving, in operating conditions of the machine, the fabric element along a fabric element path comprising a first segment beside the first side of the base and defined on the first operating area, a second, consecutive segment, at least partially transversal to the first segment and defined over the first operating and the second operating area therebetween, and a third, consecutive segment, at least partially transversal to the second segment and defined on the second operating area, wherein the first segment, the second segment and the third segment define a fabric element path basically "U"-shaped around the base, optionally the third segment being at least partially or basically parallel to the first segment and having a length basically identical or comparable with a length of the first segment.

In a 78$^{th}$ aspect in accordance with the 77$^{th}$ aspect, the slide is configured for moving the fabric element along the first segment of the fabric element path parallel to the first side of the base, the sewing machine being configured for sewing the second longitudinal edge of the fabric element to the middle segment of the second edge portion of the first end of the tubular fabric while moving with the slide the fabric element along the first segment of the fabric element path.

In a 79$^{th}$ aspect in accordance with the 76$^{th}$ or 77$^{th}$ or 78$^{th}$ aspect, the slide is configured for moving, in operating conditions of the machine, the fabric element along a fabric element path further comprising a fourth, consecutive segment, at least partially transversal to the third segment, and a fifth, consecutive segment, at least partially transversal to the fourth segment, wherein the third segment, the fourth segment and the fifth segment define a fabric element path basically "U"-shaped on the second operating area, the fifth segment being beside the second side of the base, the third segment having a greater distance from the second side of the base than a distance of the fifth segment from the second side of the base.

In an 80$^{th}$ aspect in accordance with the 79$^{th}$ aspect, the slide is configured for moving the fabric element along the fifth segment of the fabric element path parallel to the second side of the base, the sewing machine being configured for sewing the first longitudinal edge of the fabric element to the middle segment of the first edge portion of the first end of the tubular fabric while moving with the slide the fabric element along the fifth segment of the fabric element path.

In an 81$^{st}$ aspect in accordance with any one of the aspects from the 1$^{st}$ to the 80$^{th}$, the machine further comprises an unloading station configured for allowing unloading of the men's underwear item downstream from the sewing station.

In an 82$^{nd}$ aspect in accordance with any one of the aspects from the 76$^{th}$ to the 81$^{st}$, the slide is configured for moving, in operating conditions of the machine, the men's underwear item along a fabric element path further comprising a sixth segment, consecutive to the fifth segment and connecting the fifth segment to the unloading station, optionally the sixth segment being at least partially transversal to the fifth segment.

In an 83$^{rd}$ aspect in accordance with any one of the aspects from the 1$^{st}$ to the 82$^{nd}$, the machine defines a forward path for the tubular fabric through the machine and a forward path for the fabric element through the machine, which are transversal to one another and lead to or near the sewing station.

In an 84$^{th}$ aspect in accordance with any one of the aspects from the 3$^{rd}$ to the 83$^{rd}$, the machine further comprises a control unit configured for:

before sewing the first longitudinal edge of the fabric element to the middle segment of the first edge portion of the first end of the tubular fabric, driving the first take-up device and/or the moving device so as to align at least one of the first transversal edge and the second transversal edge of the fabric element with at least one respective end segment of the first edge portion, before sewing the second longitudinal edge of the fabric element to the middle segment of the second edge portion of the first end of the tubular fabric, driving the second take-up device and/or the moving device so as to align at least one of the first transversal edge and the second transversal edge of the fabric element with at least one respective segment of the second edge portion.

In an 85$^{th}$ aspect in accordance with any one of the aspects from the 1$^{st}$ to the 84$^{th}$, said tubular fabric has an inner seam developing on the first edge portion and on the second edge portion, the fabric element having inner seams defined on the first longitudinal edge and on the second longitudinal edge, said inner seams being designed to be placed in an inner portion of the men's underwear item so as not to be basically visible with the men's underwear item in use.

In an 86$^{th}$ aspect in accordance with the 85$^{th}$ aspect, the machine further comprises a control unit configured for:

before sewing the first longitudinal edge of the fabric element to the middle segment of the first edge portion of the first end of the tubular fabric, driving the first take-up device and/or the moving device so as to align the inner sewing portion developing on the first edge portion of the first end of the tubular fabric with the inner seam of the first longitudinal edge of the fabric element, before sewing the second longitudinal edge of the fabric element to the middle segment of the second edge portion of the first end of the tubular fabric, driving the second take-up device and/or the moving device so as to align the inner sewing portion developing on the second edge portion of the first end of the tubular fabric with the inner seam of the first longitudinal edge of the fabric element.

In an 87$^{th}$ aspect in accordance with any one of the aspects from the 1$^{st}$ to the 86$^{th}$, the machine is configured for automating the manufacturing of men's underwear such as boxers.

In an 88$^{th}$ aspect in accordance with any one of the aspects from the 1$^{st}$ to the 87$^{th}$, the machine is specifically designed for manufacturing boxers.

In an 89$^{th}$ aspect in accordance with any one of the aspects from the 1$^{st}$ to the 88$^{th}$, the machine is configured for implementing a plurality of productive cycles, each aiming at manufacturing a pair of boxers, so as to manufacture a series of boxers one pair after the other.

In a 90$^{th}$ aspect in accordance with any one of the aspects from the 29$^{th}$ to the 89$^{th}$, the machine comprises a control unit operatively connected to the first pick-up station and configured for:

driving the first pick-up station so as to execute a first pick-up of a tubular fabric from the first loading station, after the first pick-up, driving the first pick-up station so as to execute a second pick-up of a tubular fabric from the first loading station.

In a 91$^{st}$ aspect in accordance with the 90$^{th}$ aspect, the control unit is configured for driving the first pick-up station so as to execute the second pick-up of a tubular fabric from the first loading station after a desired condition occurs.

In a 92$^{nd}$ aspect in accordance with the 91$^{st}$ aspect, the desired condition involves the tubular fabric picked up with the first pick-up reaching a given station placed downstream from the first pick-up station, such as the handling station or the sewing station.

In a 93$^{rd}$ aspect in accordance with any one of the aspects from the 32$^{nd}$ to the 92$^{nd}$, the machine comprises a control unit operatively connected to the second pick-up station and configured for:

driving the second pick-up station so as to execute a first pick-up of a tubular fabric from the second loading station, after the first pick-up, driving the second pick-up station so as to execute a second pick-up of a tubular fabric from the second loading station.

In a 94$^{th}$ aspect in accordance with the 93$^{rd}$ aspect, the machine comprises a control unit operatively connected to the second pick-up station and configured for:

driving the second pick-up station so as to execute a first pick-up of a tubular fabric from the second loading station, after the first pick-up, separating a fabric element from the tubular fabric picked up, after separating the fabric element, driving the moving device so as to move the fabric element towards the sewing station, driving the second pick-up station so as to separate a further fabric element from the tubular fabric picked up.

In a 95$^{th}$ aspect in accordance with the 94$^{th}$ aspect, the control unit is configured for driving the moving device so as to move said fabric element towards the sewing station when a desired condition occurs.

In a 96$^{th}$ aspect in accordance with the 95$^{th}$ aspect, the desired condition involves the fabric element reaching a given station placed downstream from the second pick-up station, such as the sewing station.

In a 97$^{th}$ aspect in accordance with any one of the aspects from the 93$^{rd}$ to the 96$^{th}$, the control unit is configured for driving the second pick-up station so as to execute the second pick-up of a further tubular fabric from the second loading station after a desired condition occurs.

In a 98$^{th}$ aspect in accordance with the 97$^{th}$ aspect, the desired condition involves the separation of a maximum number of fabric elements from the tubular fabric picked up with the first pick-up and/or the end of the tubular fabric picked up with the first pick-up.

In a 99$^{th}$ aspect, it is provided for a use of the machine according to any one of the aspects from the 1$^{st}$ to the 98$^{th}$ for manufacturing men's underwear such as boxers from:

a tubular fabric and a fabric element, or a first tubular fabric and a second tubular fabric from which at least a fabric element can be separated.

In a 100$^{th}$ aspect, it is provided for a use of the machine according to any one of the aspects from the 1$^{st}$ to the 98$^{th}$ for manufacturing men's underwear such as boxers from a tubular fabric (first tubular fabric) and from a further tubular fabric (second tubular fabric).

In a 101$^{st}$ aspect, it is provided for a use of the machine according to any one of the aspects from the 1$^{st}$ to the 98$^{th}$ for manufacturing men's underwear such as boxers from a tubular fabric (first tubular fabric) and from a further tubular fabric (second tubular fabric), made of the same fabric and/or manufactured with the same type of knitting machine and/or by means of a circular knitting machine for knitted or hosiery items.

In a 102$^{nd}$ aspect, it is provide for a method for manufacturing men's underwear such as boxers, comprising at least the following steps:

providing a tubular fabric having a first end and a second end opposed to one another, between which a fabric coat delimiting a tubular duct develops, each end exhibiting an edge delimiting a hollow access port apt to enable access to the tubular duct, the edge of the first end comprising a first edge portion and a second edge portion that are adjacent to one another and cooperate so as to delimit the hollow access port of the first end, the first edge portion and the second edge portion comprising a respective middle segment designed to be sewn, and respective end segments opposed to the respective middle segment, placing the first edge portion and the second edge portion so as to define between them an intermediate area, providing a fabric element or a further tubular fabric (second tubular fabric) from which at least a fabric element can be separated, arranging the fabric element on said intermediate operating area, sewing the first edge portion and the second edge portion to respective longitudinal edges of the fabric element so as to obtain a pair of boxers.

In a 103$^{rd}$ aspect in accordance with the 102$^{nd}$ aspect, placing the fabric element on said intermediate operating area comprises placing the fabric element so that a first longitudinal edge of the fabric element and the middle segment of said first edge portion at least partially overlap or face each other, and a second longitudinal edge of the fabric element, opposed to said first longitudinal edge, and the middle segment of said second edge portion at least partially overlap or face each other.

In a 104$^{th}$ aspect in accordance with the one 103$^{rd}$ aspect, sewing the first edge portion and the second edge portion to respective longitudinal edges of the fabric element so as to obtain a pair of boxers comprises:

sewing the first longitudinal edge of the fabric element to the middle segment of the first edge portion of the first end of the tubular fabric so as to make the fabric element integral with the first edge portion, sewing the second longitudinal edge of the fabric element to the middle segment of the second edge portion of the first end of the tubular fabric so as to make the fabric element integral with the second edge portion.

In a 105$^{th}$ aspect in accordance with the 104$^{th}$ aspect, the sewing steps are performed so as to engage the fabric element to the first edge portion and to the second edge portion of the first end of the tubular fabric, thus forming a men's underwear item such as a pair of boxers.

In a 106$^{th}$ aspect in accordance with the 104$^{th}$ or 105$^{th}$ aspect, the sewing steps are performed so that a first transversal edge and a second transversal edge of the fabric element, which are transversal to the longitudinal edges of the fabric element, opposed to one another and adjacent to respective end lengths of the first edge portion and of the second edge portion, delimit at least partially, together with the respective adjacent end lengths, respective hollow portions of the men's underwear item designed to act as a guide for the lower limbs of a user of the men's underwear item, the second end of the tubular fabric being designed to surround, with the men's underwear item in use, the user's torso.

In a 107$^{th}$ aspect in accordance with any one of the aspects from the 102$^{nd}$ to the 106$^{th}$, the method further comprises the steps of:

spreading the middle segment of the first edge portion, spreading the middle segment of the second edge portion.

In a 108$^{th}$ aspect in accordance with any one of the aspects from the 102$^{nd}$ to the 107$^{th}$, placing the first edge portion and the second edge portion so as to defined an intermediate operating area therebetween comprises:

catching at least one of the first edge portion and the second edge portion, moving at least one of the first edge portion and the second edge portion.

In a 109$^{th}$ aspect in accordance with any one of the aspects from the 102$^{nd}$ to the 108$^{th}$, placing the first edge portion and the second edge portion so as to defined an intermediate operating area therebetween comprises:

catching the second edge portion, moving the second edge portion with respect to the first edge portion.

In a 110$^{th}$ aspect in accordance with the 109$^{th}$ aspect, moving the second edge portion with respect to the first edge portion comprises moving the second edge portion to the same height as the first edge portion, i.e. moving a second take-up device carrying the second edge portion with respect to a first take-up device carrying the first edge portion.

In a 111$^{th}$ aspect in accordance with the 110$^{th}$ aspect, moving the second edge portion with respect to the first edge portion comprises, before the step of moving the second edge portion and if the second edge portion and the first edge portion are in a configuration in which the second edge portion is placed below the first edge portion and/or the first edge portion and the second edge portion are vertically aligned, displacing the second edge portion from the first edge portion.

In a 112$^{th}$ aspect in accordance with the 110$^{th}$ or 111$^{th}$ aspect, moving the second edge portion to the same height as the first edge portion comprises rotating the second edge portion, from an initial position of rotation to a final position of rotation in which the second edge portion faces the first edge portion and defines so as to defined said intermediate operating area therebetween.

In a 113$^{th}$ aspect in accordance with the 111$^{th}$ or 112$^{th}$ aspect, displacing the second edge portion from the first edge portion comprises moving the second edge portion, e.g. by means of a moving mechanism acting upon the second edge portion, from a starting position in which the second edge portion is placed below the first edge portion and/or is aligned vertically with the first edge portion as far as the initial position of rotation.

In a 114$^{th}$ aspect in accordance with the 113$^{th}$ aspect, moving the second edge portion from a starting position in which the second edge portion is placed below the first edge portion and/or is aligned vertically with the first edge portion as far as the initial position of rotation, comprises shifting horizontally, by means of a moving mechanism acting upon the second edge portion, the second edge portion from the starting position to the initial position of rotation.

In a 115$^{th}$ aspect in accordance with any one of the aspects from the 102$^{nd}$ to the 114$^{th}$, placing the fabric element on said intermediate operating area comprises placing at least partially a first longitudinal edge of the fabric element over the middle segment of said first edge portion, or vice versa.

In a 116$^{th}$ aspect in accordance with any one of the aspects from the 102$^{nd}$ to the 115$^{th}$, placing the fabric element on said intermediate operating area comprises placing at least partially a second longitudinal edge of the fabric element, opposed to a first longitudinal edge of the fabric element, over the middle segment of said second edge portion, or vice versa.

In a 117$^{th}$ aspect in accordance with any one of the aspects from the 102$^{nd}$ to the 116$^{th}$, the method further comprises the step of creating at least one cut or vent on the tubular fabric on the middle segment of said first edge portion or of said second edge portion, the cut or vent defining a first piece and a second piece on the respective middle segment.

In a 118$^{th}$ aspect in accordance with any one of the aspects from the 102$^{nd}$ to the 117$^{th}$, the method further comprises the following steps:

creating a first cut or vent on the tubular fabric on the middle segment of said first edge portion, the first cut or vent defining a first piece and a second piece on the middle segment of the first edge portion, creating a second cut or vent on the tubular fabric on the middle segment of said second edge portion, the second cut or vent defining a first piece and a second piece on the middle segment of the second edge portion.

In a 119$^{th}$ aspect in accordance with the 118$^{th}$ aspect, the method further comprises the steps of:

catching, by means of a first take-up device, the tubular fabric on said first edge portion, the step of creating a first cut or vent on the tubular fabric on the middle segment of said first edge portion being performed by means of a cutting element and following the step of catching, by means of the first take-up device, the tubular fabric on said first edge portion, catching, by means of a second take-up device, the tubular fabric on said second edge portion, the step of creating a second cut or vent on the tubular fabric on the middle segment of said second edge portion being performed by means of a cutting element and following the step of catching, by means of the second take-up device, the tubular fabric on said second edge portion.

In a 120$^{th}$ aspect in accordance with the 119$^{th}$ aspect, the method further comprises the following steps:

before catching, by means of the first take-up device, the tubular fabric on said first edge portion, inserting at least partially the spreading bars into the tubular duct, after inserting at least partially the spreading bars into the tubular duct, spreading the spreading bars so as to stretch and/or tension the tubular fabric.

In a 121$^{st}$ aspect in accordance with the 120$^{th}$ aspect, after the first cut or vent has been created on the first edge portion and the second cut or vent has been created on the second edge portion, removing the spreading bars from the tubular duct so as to disengage them from the tubular fabric.

In a 122$^{nd}$ aspect in accordance with any one of the aspects from the 118$^{th}$ to the 121$^{st}$, the step of creating the first cut or vent and the step of creating the second cut or vent are performed by means of at least one cutting element, such as a pair of scissors or a blade, the step of creating the first cut comprising a step of moving, e.g. at a first point in time, the cutting element near the first edge portion so as to create the first cut or vent, the step of creating the second cut or vent comprising a step of moving, e.g. at a second point in time optionally after the first point in time, the cutting element near the second edge portion so as to create the second cut or vent.

In a 123$^{rd}$ aspect in accordance with any one of the aspects from the 118$^{th}$ to the 122$^{nd}$, the step of creating the first cut or vent and the step of creating the second cut or vent are performed by means of the same cutting element, the step of creating the second cut or vent being performed at a second point in time after the first point in time.

In a 124$^{th}$ aspect in accordance with any one of the aspects from the 107$^{th}$ to the 123$^{rd}$:

spreading the middle segment of the first edge comprises spreading, by means of the first take-up device, the first piece and the second piece of the middle segment of the first edge portion, spreading the middle segment of the second edge comprises spreading, by means of the second take-up device, the first piece and the second piece of the middle segment of the second edge portion.

In a 125$^{th}$ aspect in accordance with the 124$^{th}$ aspect:

spreading, by means of the first take-up device, the first piece and the second piece of the middle segment of the first edge portion comprises placing the first piece and the second piece of the middle segment of the first edge portion, e.g. along a broken or basically rectilinear line, so as to allow the first longitudinal edge of the fabric element to be sewn to the middle segment of said first edge portion along a basically rectilinear sewing line, spreading, by means of the second take-up device, the first piece and the second piece of the middle segment of the second edge portion comprises placing the first piece and the second piece of the middle segment of the second edge portion, e.g. along a broken or basically rectilinear line, so as to allow the first longitudinal edge of the fabric element to be sewn to the middle segment of said second edge portion along a basically rectilinear sewing line.

In a 126$^{th}$ aspect in accordance with the 125$^{th}$ aspect, spreading, by means of the first take-up device, the first piece and the second piece of the middle segment of the first edge portion comprises:

placing the first piece and the second piece of the middle segment of the first edge portion transversally to one another so as to define basically a broken line, e.g. a basically "L"-shaped broken line, after placing the pieces, sewing at least one of the first piece and the second piece to a portion of the first longitudinal edge of the fabric element, after sewing one of the first piece and the second piece to a portion of the first longitudinal edge of the fabric element, aligning the first piece and the second piece of the middle segment of the first edge portion along a basically rectilinear line, after aligning the pieces, sewing the other one of the first piece and the second piece of the middle segment of the first edge portion to a respective portion of the first longitudinal edge of the fabric element.

In a 127$^{th}$ aspect in accordance with the 125$^{th}$ or 126$^{th}$ aspect, spreading, by means of the second take-up device, the first piece and the second piece of the middle segment of the second edge portion comprises:

placing the first piece and the second piece of the middle segment of the second edge portion transversally to one another so as to define basically a broken line, e.g. a basically "L"-shaped broken line, after placing the pieces, sewing at least one of the first piece and the second piece to a portion of the second longitudinal edge of the fabric element, after sewing one of the first piece and the second piece to a portion of the second longitudinal edge of the fabric element, aligning the first piece and the second piece of the middle segment of the second edge portion along a basically rectilinear line, after aligning the pieces, sewing the other one of the first piece and the second piece of the middle segment of the second edge portion to a respective portion of the second longitudinal edge of the fabric element.

In a 128$^{th}$ aspect in accordance with any one of the aspects from the 102$^{nd}$ to the 127$^{th}$, placing the fabric element on said intermediate operating area comprises placing the first edge portion and the second edge portion in a pre-established operating position in which they face each other.

In a 129$^{th}$ aspect in accordance with the one 128$^{th}$ aspect, placing the first edge portion and the second edge portion in a given operating position in which they face each other comprises:

placing the first piece of the first edge portion in front of the first piece of the second edge portion at a first distance from the first piece of the second edge portion so as to allow the positioning of the fabric element between the first piece of the first edge portion and the first piece of the second edge portion, placing the second piece of the first edge portion in front of the second piece of the second edge portion at a second distance from the second piece of the second edge portion so as to allow the positioning of the fabric element between the second piece of the first edge portion and the second piece of the second edge portion.

In a 130$^{th}$ aspect in accordance with the 129$^{th}$ aspect, the first distance and the second distance are identical.

In a 131$^{st}$ aspect in accordance with the 129$^{th}$ or 130$^{th}$ aspect, the first distance and/or the second distance are at least identical or correspond to a distance between the first longitudinal edge of the fabric element and the second longitudinal edge of the fabric element.

In a 132$^{nd}$ aspect in accordance with any one of the aspects from the 104$^{th}$ to the 131$^{st}$, the method further comprises the steps of:

before sewing the first longitudinal edge of the fabric element to the middle segment of the first edge portion of the first end of the tubular fabric, aligning, e.g. by means of a first take-up device and/or a moving device, at least one of the first transversal edge and the second transversal edge of the fabric element with at least one respective end segment of the first edge portion, before sewing the second longitudinal edge of the fabric element to the middle segment of the second edge portion of the first end of the tubular fabric, aligning, by means of a second take-up device and/or a moving device, at least one of the first transversal edge and the second transversal edge of the fabric element with at least one respective end segment of the second edge portion.

In an 133$^{rd}$ aspect in accordance with any one of the aspects from the 102$^{nd}$ to the 132$^{nd}$, providing a tubular fabric comprising providing a tubular fabric having an inner seam developing on the first edge portion and on the second edge portion, the fabric element having inner seams defined on the first longitudinal edge and on the second longitudinal edge, said inner seams being designed to be placed in an inner portion of the men's underwear item so as not to be basically visible with the men's underwear item in use.

In a 134$^{th}$ aspect in accordance with the 133$^{rd}$ aspect, the method further comprises the following steps:

before sewing the first longitudinal edge of the fabric element to the middle segment of the first edge portion of the first end of the tubular fabric, aligning the inner sewing portion developing on the first edge portion of the first end of the tubular fabric with the inner seam of the first longitudinal edge of the fabric element, before sewing the second longitudinal edge of the fabric element to the middle segment of the second edge portion of the first end of the tubular fabric, aligning the inner sewing portion developing on the second edge portion of the first end of the tubular fabric with the inner seam of the first longitudinal edge of the fabric element.

In a 135$^{th}$ aspect in accordance with any one of the aspects from the 102$^{nd}$ to the 134$^{th}$, providing a tubular fabric comprises providing a pre-cut or pre-vented tubular fabric having at least one of a first cut or vent on the middle segment of said first edge portion and a second cut or vent on the middle segment of said second edge portion, the first cut or vent defining a first piece and a second piece of the middle segment of the first edge portion, the second cut or vent defining a first piece and a second piece of the middle segment of the second edge portion.

In a 136$^{th}$ aspect in accordance with any one of the aspects from the 102$^{nd}$ to the 135$^{th}$, placing the first edge portion and the second edge portion so as to define therebetween an intermediate operating area comprises moving the first piece and the second piece of the middle segment of the first edge portion, and the first piece and the second piece of the middle segment of the second edge portion so as to define an intermediate operating area between the middle segments of the first edge portion and of the second edge portion.

In a 137$^{th}$ aspect in accordance with the 136$^{th}$ aspect, moving the first piece and the second piece of the middle segment of the first edge portion and the first piece and the second piece of the middle segment of the second edge portion comprises spreading the first piece and the second piece of the middle segment of the first edge portion and spreading the first piece and the second piece of the middle segment of the second edge portion.

In a 138$^{th}$ aspect in accordance with any one of the aspects from the 102$^{nd}$ to the 137$^{th}$, providing a further tubular fabric (second tubular fabric) from which at least one fabric element can be separated, comprises:

providing a further tubular fabric (second tubular fabric) having a first end and a second end, opposed to one another, between which a fabric coat delimiting a tubular duct develops, separating at least one fabric element from the further tubular fabric, the fabric element being basically or comprising a strip or length of the further tubular fabric.

In a 139$^{th}$ aspect in accordance with the 138$^{th}$ aspect, separating at least one fabric element from the further tubular fabric comprises cutting the further tubular aspect.

In a 140$^{th}$ aspect in accordance with the 139$^{th}$ aspect, cutting the further tubular fabric comprises:

if the further tubular fabric is intact, i.e. it has not undergone any separating operation yet, executing a first cutting operation aiming at opening the coat of said further tubular fabric, and executing a second cutting operating aiming at removing a fabric element, if the further tubular fabric has already undergone a separating operation, executing a cutting operation aiming at removing a fabric element.

In a 141$^{st}$ aspect in accordance with any one of the aspects from the 102$^{nd}$ to the 140$^{th}$, the method comprises a step of arranging a control unit configured for controlling and/or monitoring the performance of at least one step or a plurality of steps or all the steps of the method as per the aspects from the 102$^{nd}$ to the 140$^{th}$ and/or as per the appended method claims.

In a 142$^{nd}$ aspect in accordance with any one of the aspects from the 102$^{nd}$ to the 141$^{st}$, the method comprises a step of arranging a control unit configured for implementing the method according to any one of the aspects from the 102$^{nd}$ to the 140$^{th}$ and/or to any one of the method claims on a machine according to any one of the aspects from the 1$^{st}$ to the 98$^{th}$ and/or to any one of the appended machine claims.

In a 143$^{rd}$ aspect in accordance with any one of the aspects from the 102$^{nd}$ to the 142$^{nd}$, the method comprises a step of arranging a machine according to any one of the aspects from the 1$^{st}$ to the 98$^{th}$ and/or to any one of the appended machine claims.

In a 144$^{th}$ aspect in accordance with any one of the aspects from the 1$^{st}$ to the 143$^{rd}$, the first edge portion and the second edge portion are complementary to one another so as to form an edge of the first end of the tubular fabric.

In a 145$^{th}$ aspect in accordance with any one of the aspects from the 1$^{st}$ to the 144$^{th}$, the first edge portion is a first ring-shaped half of the edge of the first end of the tubular fabric, and the second edge portion is a second ring-shaped half of the edge of the first end of the tubular fabric.

In a 146$^{th}$ aspect in accordance with any one of the aspects from the 1$^{st}$ to the 145$^{th}$, the first edge portion and the second edge portion are specular to one another, e.g. with reference to a spread configuration of the first end of the tubular fabric.

In a 147$^{th}$ aspect in accordance with any one of the aspects from the 1$^{st}$ to the 146$^{th}$, the first edge portion and the second edge portion have the same extension delimiting on the perimeter a part of the access port of the first end of the tubular fabric.

In a 148$^{th}$ aspect in accordance with any one of the aspects from the 1$^{st}$ to the 147$^{th}$, each cut or vent has a smaller longitudinal extension, defined parallel to an direction of axial development of the tubular fabric, than a length of the tubular fabric, the length of the tubular fabric being defined along said axial direction as the distance between the first end and the second end of the tubular fabric.

In a 149$^{th}$ aspect in accordance with any one of the aspects from the 1$^{st}$ to the 148$^{th}$, the first vent and the second vent have the same longitudinal extension.

In a 150$^{th}$ aspect in accordance with any one of the aspects from the 1$^{st}$ to the 149$^{th}$, the ratio of the longitudinal extension of each vent to the length of the tubular fabric can be between 0.1 and 0.7, in particular between 0.2 and 0.6, optionally between 0.3 and 0.5.

In a 151$^{st}$ aspect in accordance with any one of the aspects from the 1$^{st}$ to the 150$^{th}$, each tubular fabric is a tubular knitted item manufactured by means of a circular knitting machine for knitted or hosiery items.

In a 152$^{nd}$ aspect in accordance with any one of the aspects from the 1$^{st}$ to the 151$^{st}$, said further tubular fabric (second tubular fabric) is separated with respect to said tubular fabric (first tubular fabric).

In a 153$^{rd}$ aspect in accordance with any one of the aspects from the 1$^{st}$ to the 152$^{nd}$, the first tubular fabric and the second tubular fabric are made of the same fabric.

In a 154$^{th}$ aspect in accordance with any one of the aspects from the 1$^{st}$ to the 153$^{rd}$, the first tubular fabric and the second tubular fabric are manufactured with the same type of knitting machine and/or the same circular knitting machine for knitted or hosiery items.

In a 155$^{th}$ aspect in accordance with any one of the aspects from the 1$^{st}$ to the 154$^{th}$, each tubular fabric has a length defined as the distance between the first end and the second end, the length of the second tubular fabric being smaller than the length of the first tubular fabric.

In a 156$^{th}$ aspect in accordance with any one of the aspects from the 1$^{st}$ to the 155$^{th}$, each tubular fabric has a diameter, the diameter of the second tubular fabric being larger than the diameter of the first tubular fabric.

BRIEF DESCRIPTION OF THE DRAWINGS

Some embodiments and aspects of the invention will be described below with reference to the accompanying drawings, provided to a mere indicative and thus non-limiting purpose, in which.

DEFINITIONS AND CONVENTIONS

Figure 1:
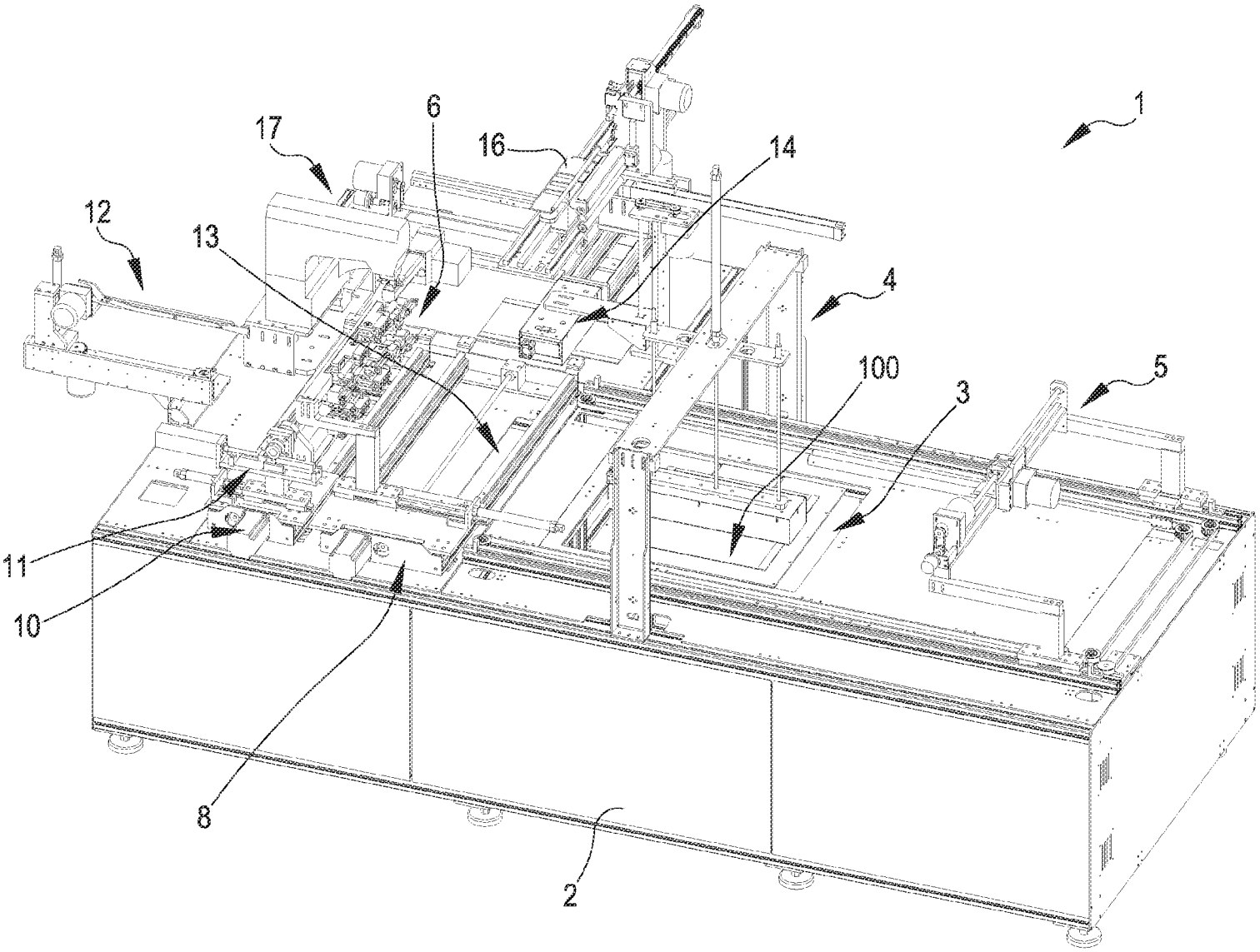
FIG. 1 is a perspective view of the machine for manufacturing boxers in accordance with an embodiment of the present invention.

It should be pointed out that in the present detailed description, corresponding parts shown in the various figures are designated with the same numerals. The figures may show the object of the invention by means of representations that are not to scale; therefore, parts and components shown in the figures and related to the object of the invention may refer to schematic representations only. In the context of the present invention, the use of terms such as "on", "upper", "above", "under", "lower", "below", "beside", "side", "laterally", "horizontal", "horizontally", "vertical", "vertically", "frontal", "rear", "back" and similar words relates, unless otherwise specified, to at least one spatial orientation which the object of the invention can normally take in operating or use conditions. See about this the accompanying figures showing at least one possible spatial orientation of the machine for manufacturing men's underwear such as boxers. Unless otherwise specified, terms such as "condition" or "configuration" can be used interchangeably in the context of the present disclosure.

Some definitions to be used for understanding the present invention are listed below:

- the term "tubular fabric" designates a tubular item, e.g. a knitted item,
- the wording "fabric element" designates a textile item, e.g. a knitted item, designed to cooperate with a "tubular fabric" for obtaining a men's underwear item such as a pair of boxers,
- the wording "knitted" means manufactured with a circular knitting machine for knitted or hosiery items,
- the wordings "downstream" and "upstream", which shall be used below with reference to components, stations or devices, are to be understood, unless otherwise specified, with reference to a path and/or a forward direction of a respective tubular fabric or of the fabric element along the machine or with reference to an operating sequence of the steps of the method which the respective tubular fabric or the fabric element are subjected to,
- the wording "motor element" designates any element configured for acting upon the component or device which it is operatively connected to, so as to supply the power required for moving it, which can take place by means of suitable kinematic systems located between the motor element and the component or device which the motor element is operatively connected to.

Control Unit

The machine for manufacturing men's underwear such as boxers described and claimed herein can comprise at least one control unit apt to control/drive/manage use conditions implemented by the machine itself. Similarly, the method for manufacturing men's underwear such as boxers described and claimed herein can use at least one control unit apt to control/drive/manage the steps of the method and, in addition or as an alternative, apt to control/drive use conditions implemented by the machine itself.

The control unit can be a single control unit or include a plurality of distinct control units, depending on design choices and operating requirements.

The wording "control unit" designates an electronic component that can comprise at least one of: a digital processor (CPU), an analogical circuit, or a combination of one or more digital processors with one or more analogical circuits. The control unit can be "configured" or "programmed" for executing some steps: this can be done in practice with any means allowing to configure or program the control unit. For instance, in case of a control unit including one or more CPUs and one or more storages, one or more programs can be stored in suitable storage banks connected to the CPU or CPUs; the program or programs contain instructions which, when executed by the CPU or CPUs, program or configure the control unit for executing the operations described in relation to the control unit. As an alternative, if the control unit is or includes analogical hardware, the circuit of the control unit can be designed for including hardware configured, in use, for processing electric signals so as to execute the steps related to the control unit.

DETAILED DESCRIPTION

Machine

The numeral 1 globally designates a machine for manufacturing boxers B. The machine 1 comprises a frame 2 to which a plurality of devices defining the stations of the machine 1 itself is engaged. The machine 1 can further comprise a control unit apt to manage the operation of the machine itself.

Figure 2:
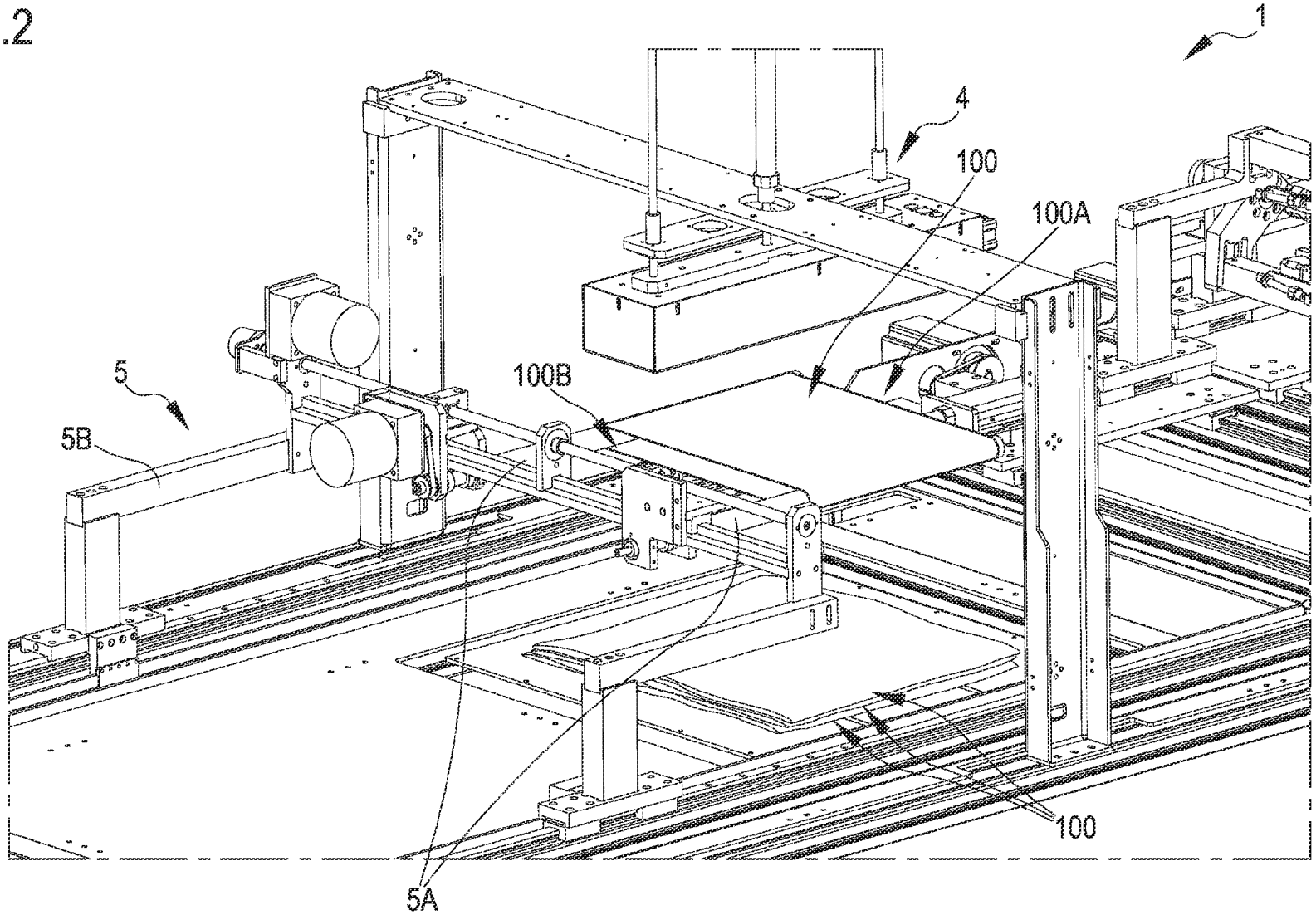
FIG. 2 is a perspective view of the spreading station of the machine of FIG. 1 while spreading a first tubular fabric.
Figure 4:
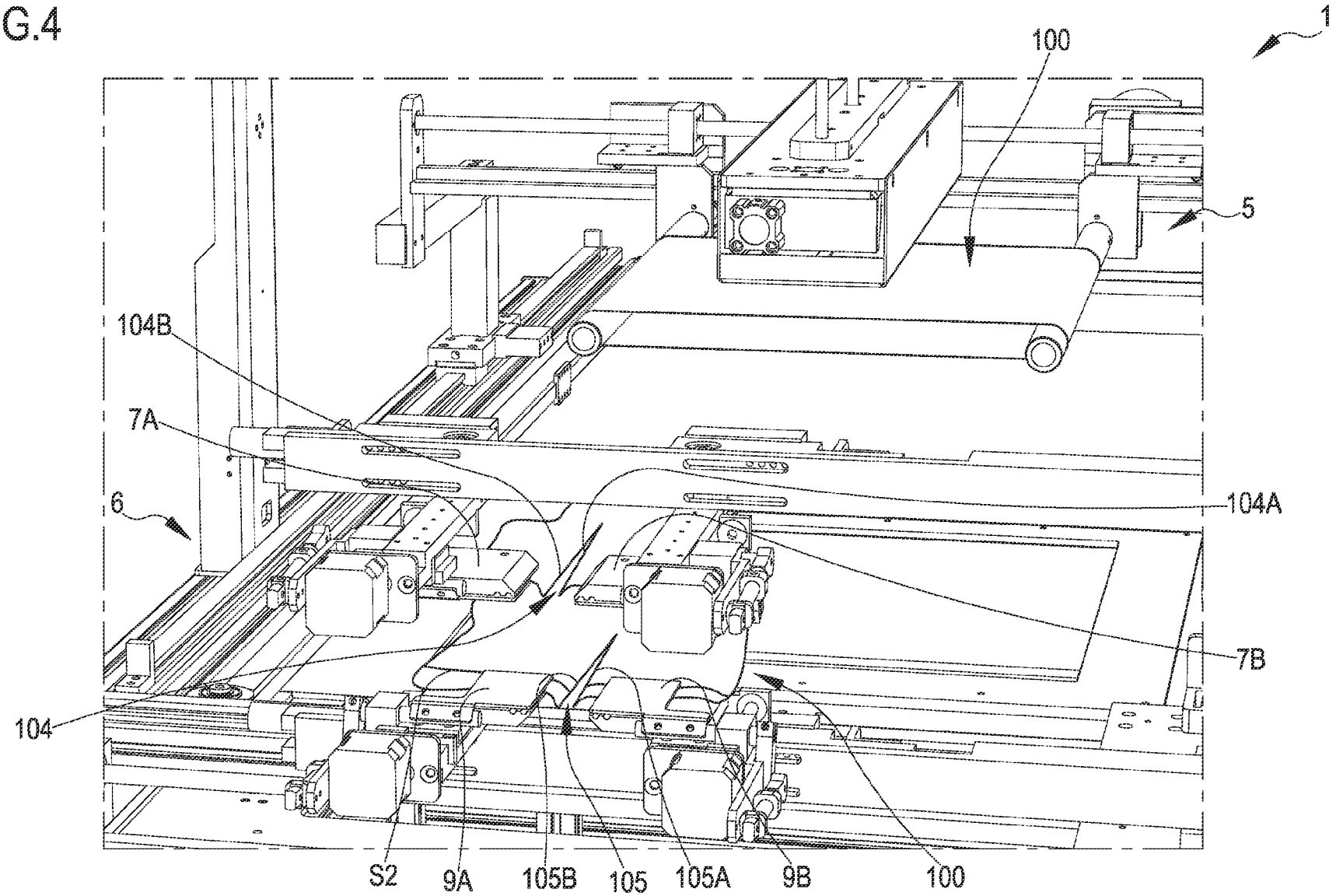
FIG. 4 is a perspective view of the handling station of the machine of FIG. 1, showing an operating configuration, after creating cuts or vents on the first tubular fabric, in which a first edge portion and a second edge portion of the first end of the first tubular fabric are at different heights from one another.

The machine 1 comprises a first loading station 3 onto which a stack of tubular fabrics 100 can be loaded. Loading a stack of tubular fabrics 100 allows the machine 1 to implement a plurality of productive cycles, each aiming at manufacturing a pair of boxers B, so as to manufacture a series of boxers B one pair after the other. For instance, the machine 1, under the supervision of the control unit, can start a second productive cycle while a productive cycle is still taking place and is not completed yet; thus the machine 1 can perform at least two productive cycles at the same time. See about this FIG. 4, showing two tubular fabrics 100 processed by different stations of the machine 1, which are therefore at different stages of the method for manufacturing boxers B. The first loading station 3 has a loading plate which can be moved vertically with respect to the frame 2 so as to be raised or lowered with respect to a floor of the frame 2. The tubular fabrics 100 can be loaded onto the loading plate manually, e.g. by an operator preparing or monitoring the machine 1. In addition or as an alternative, the tubular fabrics 100 can be loaded onto the loading plate in an automated manner, by means of an automated or robot arm. FIG. 2 shows a stack of tubular fabrics 100 arranged on the loading plate. In accordance with the embodiment shown in the appended claims, the tubular fabrics 100 loaded onto the first loading station 3 can be manufactured by means of a circular knitting machine for knitted or hosiery items. The tubular fabrics 100 loaded into the loading station 3 have a first end 100A and a second end 1008, opposed to one another, between which a fabric coat delimiting a tubular duct develops. The tubular fabric 100 has an direction of axial development through the first end 100A and the second end 1008. Each end 100A, 100B has an edge delimiting a hollow access port apt to enable access to the tubular duct; the edge of the first end 100A comprises a first edge portion 101 and a second edge portion 102 that are adjacent to one another and cooperate so as to delimit the hollow access port of the first end 100. From a geometrical point of view, the first edge portion 101 and the second edge portion 102 are complementary to one another so as to define the edge delimiting the hollow access port of the first end 100A. The first edge portion 101 and the second edge portion 102 comprise a respective middle segment 101A, 102A and respective end segments 1018, 101C, 102B, 102C opposed to the respective middle segment 101A, 102A. The tubular fabric 100 can have a constant diameter along the direction of axial development. The tubular fabric 100 can further have at least two inner seams S1, S2 developing on an inner surface of the coat delimiting the tubular duct; each inner seam develops near a respective end 100A, 100B of the tubular fabric 100. These inner seams S1, S2 develop circumferentially around the direction of axial development and are obtained before loading the tubular fabric into the machine; they can be obtained for instance by means of a circular knitting machine for knitted or hosiery items with which the tubular fabric 100 is manufactured.

The machine 1 further comprises a first pick-up station 4 configured for picking up one tubular fabric 100 at a time from the stack of tubular fabrics 100 placed on the first loading station 3. When the tubular fabric 100 has reached a given station of the machine 1, the control unit can drive the first pick-up station 4 so as to pick up another tubular fabric 100 from the stack of tubular fabrics 100 in order to start a second operating cycle of the machine 1, which will take place while the machine 1 ends the first operating cycle started when picking up the tubular fabric 100. In the embodiment shown in the accompanying figures the first pick-up station 4 is arranged above the first loading station 3 and is configured for picking up a tubular fabric 100 from the loading plate; to this purpose, the first pick-up station 4 is provided with a suction head which is vertically movable approaching or away from the loading plate. Under the supervision of the control unit, the suction head is configured for approaching the loading plate, picking up a tubular fabric 100 from the stack of tubular fabrics 100 and lift the tubular fabric while getting away from the loading plate. FIG. 1 shows the suction head close to the loading plate for picking up the tubular fabric 100.

The machine 1 further comprises a spreading station 5 configured for spreading at least partially the tubular fabric 100 so as to stretch and tension it in a suitable manner. The spreading station 5 allows to provide the tubular fabric 100 for a cutting station of the machine 1, which shall be described below in the present description. In the embodiment shown in the accompanying figures, the spreading station 5 includes a pair of spreading bars 5A configured for being distanced and approached one to the other. The spreading bars 5A can be distanced and approached one to the other by means of a dedicated motor element acting upon the latter by means of suitable kinematic systems; by way of example, these kinematic systems can include a belt. FIG. 2 shows an operating configuration of the machine 1, in which the spreading bars 5A are distanced one from the other so as to tension the tubular fabric 100 engaged to the latter. The spreading bars 5A are mounted movably with respect to the frame 2 by means of a shuttle 5B configured for moving with a relative motion with respect to the frame 2. The shuttle 5B has two opposed arms; each arm is engaged to the frame 2 along a respective rail so as to be able to slide along the latter by means of a suitable slide. The rails define a direction of movement of the shuttle 5B and thus of the spreading bars 5A carried by the latter, with respect to the frame 2. The shutter 5B, and thus the spreading bars 5B, can be moved approaching and getting away from the first pick-up station 4 by means of a dedicated motor element acting upon them by means of suitable kinematic systems; by way of example, these kinematic systems can include at least one belt equipped with return elements so as to move, by means of one dedicated motor element and in a synchronous manner, both arms which can be engaged to and integral with the belt. As an alternative, it can be provided for two motor elements, each of them being dedicated to a respective arm, which can be apt to move, e.g. in a synchronous manner by means of the monitoring of the control unit, the arms approaching or getting away from the first pick-up station 4. The spreading station 5 can further have a further dedicated motor element operatively connected, e.g. by means of a belt, to one spreading bar 5A only so as to allow the rotation thereof around its own longitudinal axis of longitudinal. In an operating configuration of the machine 1 in which the spreading bars 5A are engaged inside the tubular duct of the tubular fabric 100 and are spread so as to stretch and tension the tubular fabric, the rotation of a spreading bar 5A allows the machine 1 to suitably position the tubular fabric. In particular, the rotation of a spreading bar 5A can enable the positioning of a reference element included in the tubular element 100 on a reference position which the control unit is configured to detect; this position can be for instance a centered position at the same distance from both spreading bars 5A. By way of example, the reference position detected by the control unit by means of an encoder included in the machine 1 and acting so as to detect the angular position of the powered spreading bar 5A or by means of an optical sensor configured for detecting the presence and arrangement of the abutment element or by means of alternative sensor included in the machine 1. The reference element can be provided on the first end 100A of the first tubular fabric 100, e.g. on the first edge portion 101 of the first end 100A. The reference element can be shaped as a notch having a different color with respect to a main color of the tubular fabric 100. The other spreading bar 5A can be idle and can be drawn into rotation around its own longitudinal axis of rotation by the tubular fabric 100 moved by the powered spreading bar, so as to enable, during the rotation of the powered spreading bar, the movement of the tubular fabric around the spreading bars 5A and, optionally, the positioning of the reference element.

The machine 1 further comprises a handling station 6 configured for handling the tubular fabric 100. In particular, the handling station 6 is configured for handling the tubular fabric 100 after it has been spread out by the spreading bar 5A.

The handling station 6 comprises a first take-up device 7 configured for catching and handling the tubular fabric 100 on the first edge portion 101 of the first end 100A of the tubular fabric 100. In order to move the first take-up device 7, the handling station 6 includes a first moving mechanism 8 operatively connected to the first take-up device 7. The first moving mechanism 8 is configured for moving the first take-up device 7 along a first direction, which can be basically parallel to the direction of movement of the shuttle 5B carrying the spreading bars 5A. In the embodiment as in the accompanying figures, the first moving mechanism 8 comprises a dedicated motor element, a movable arm carrying the first take-up device 7 and a telescopic guide, to which the movable arm is engaged, apt to enable the shift of the movable arm along the first direction.

In order to handle the tubular fabric 100 the first take-up device comprises a first gripper 7A and a second gripper 7B. The presence of a pair of grippers 7A, 7B allows the first take-up device 7 to handle in a simple and highly accurate manner the first edge portion 101 of the first end 100A of the tubular fabric 100. Each gripper 7A, 7B is configured for operating between a closed and an open position. The switching of the gripper from the closed to the open position, and vice versa, can take place by means of a dedicated actuator for each gripper 7A, 7B or by one actuator for the first gripper 7A and for the second gripper 7B; the actuator or actuators can be managed by the control unit. The switching of each gripper 7A, 7B from the closed to the open position defines an inner space of the gripper 7A, 7B. In the open position, each gripper 7A, 7B allows the tubular fabric 100 to be placed, e.g. inserted, into the inner space; the switching of the gripper 7A, 7B from the open to the closed position allows the gripper 7A, 7B to catch and handle the tubular fabric 100 previously placed in the inner space. Vice versa, the switching of the gripper 7A, 7B from the closed to the open position, after the tubular fabric 100 has been caught, allows the tubular fabric 100 to be disengaged from the gripper 7A, 7B. The first gripper 7A and the second gripper 7B are configured for catching the first edge portion 101 of the first end 100A of the tubular fabric 100 on or near respective end segments 101B, 101C. The first gripper 7A and the second gripper 7B are supported by the movable arm and can shift, by means of the first moving mechanism 8, integrally with the movable arm along the first direction. The first gripper 7A and the second gripper 7B are further movable with respect to the movable arm along a second direction transversal to the first direction; in the embodiment shown in the accompanying figures, the second direction is orthogonal to the first direction and is basically parallel to a main direction of extension of the movable arm. In other terms, the first gripper 7A and the second gripper 7B can move along a movable arm, which basically acts as a rail for the first gripper 7A and the second gripper 7B of the first take-up device 7 and can shift in its turn along the first direction in accordance with the above description. The first gripper 7A and the second gripper 7B can move along the second direction getting away from and approaching one another; by way of example, in order to enable the movement of the first gripper 7A and of the second gripper 7B, the first take-up device 7 can include a dedicated motor element for each gripper or one motor element equipped with suitable kinematic systems for mutually moving the grippers 7A, 7B getting away from or approaching one another. The first gripper 7A and the second gripper 7B can further rotate getting away from or approaching one another on a lying plane of the gripper. The grippers 7A, 7B can rotate at the same time or one at a time; as an alternative, only one gripper 7A, 7B can rotate with respect to the other one 7B, 7A. The mutual rotation of the grippers 7A, 7B, i.e. the angle of rotation which a gripper can describe with respect to the other one, can be basically of 90°. During their rotation on the lying plane, the grippers 7A, 7B remain at the same height.

In accordance with the embodiment shown in the accompanying figures, the first gripper 7A and the second gripper 7B of the first take-up device 7 are mutually arranged at the same first height and are configured for catching the first edge portion 101 of the first end 100A of the tubular fabric 100 and retain it at the first height. In the present disclosure, the first height and further heights that shall be defined below are calculated with reference to the same reference surface, which can be for instance a floor of the frame 2 of the machine 1 or any surface, e.g. horizontal, of the frame 2. The heights are calculated in a transversal direction or preferably in a direction orthogonal to the reference surface or, in addition or as an alternative, to the gripper 7A, 7B. The heights can be defined as the distance of a gripper 7A, 7B from the reference surface; the distance of the gripper 7A, 7B from the reference surface can be calculated as the distance of a lower or upper surface of the gripper 7A, 7B from the reference surface.

The handling station 6 further comprises a second take-up device 9 configured for catching and handling the tubular fabric 100 on the second edge portion 102 of the first end 100A of the tubular fabric 100. The presence of a first take-up device 7 and of a second take-up device 9 allows the handling station 6 to handle in a simple and highly accurate manner the tubular fabric 100.

In order to move the second take-up device 9, the handling station 6 includes a second moving mechanism 10 operatively connected to the second take-up device 9. The second moving mechanism 10 is configured for moving the second take-up device 9 along the first direction parallel to the first take-up device 7. In the embodiment as in the accompanying figures, the second moving mechanism 10 comprises a dedicated motor element, a movable crossbar carrying the second take-up device 9 and a telescopic guide, to which the movable crossbar is engaged, apt to enable the shift of the crossbar along the first direction.

Figure 3:
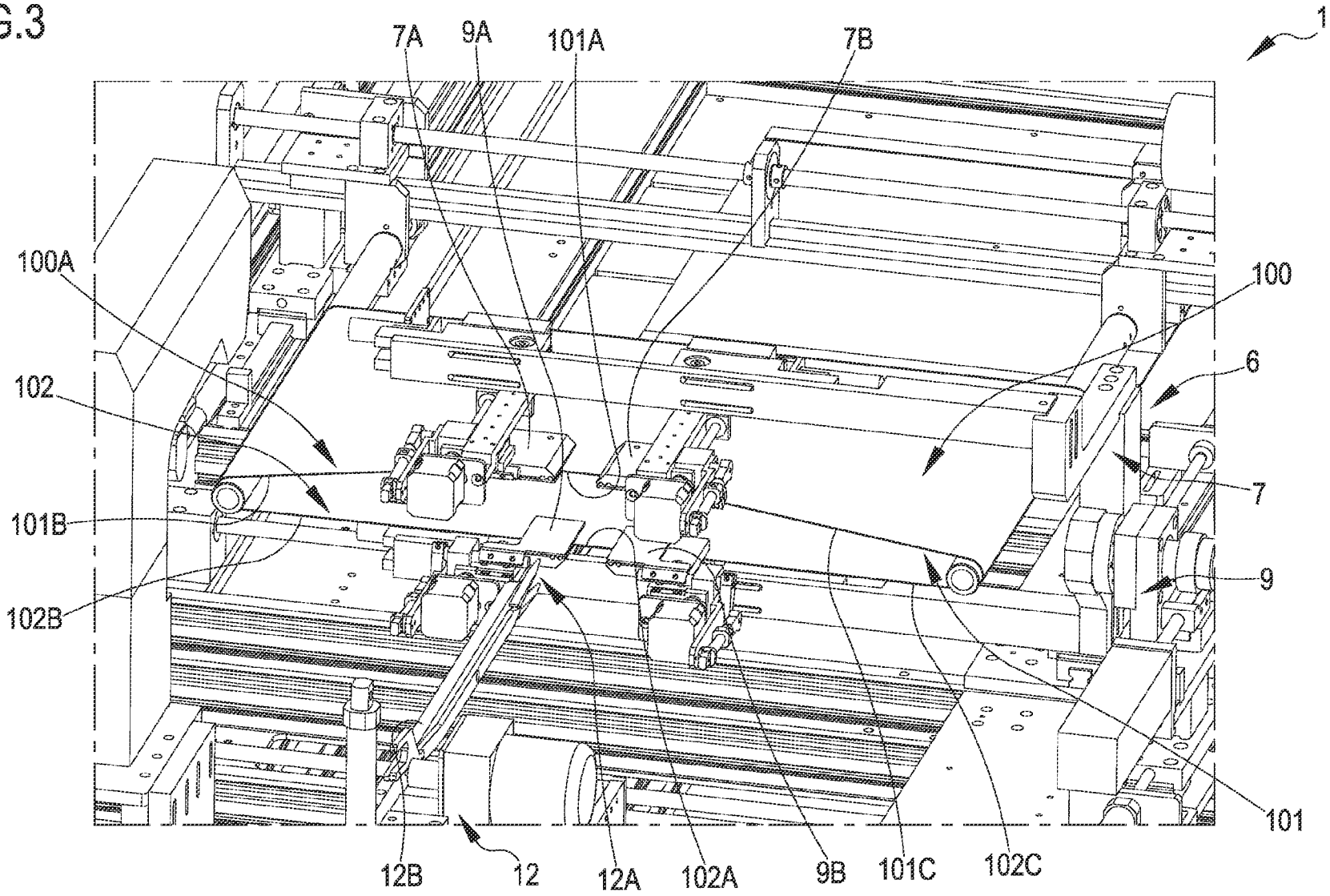
FIG. 3 is a perspective view of the handling station and of the cutting station of the machine of FIG. 1 while catching the first tubular fabric before creating cuts or vents on the first tubular fabric.
Figure 5:
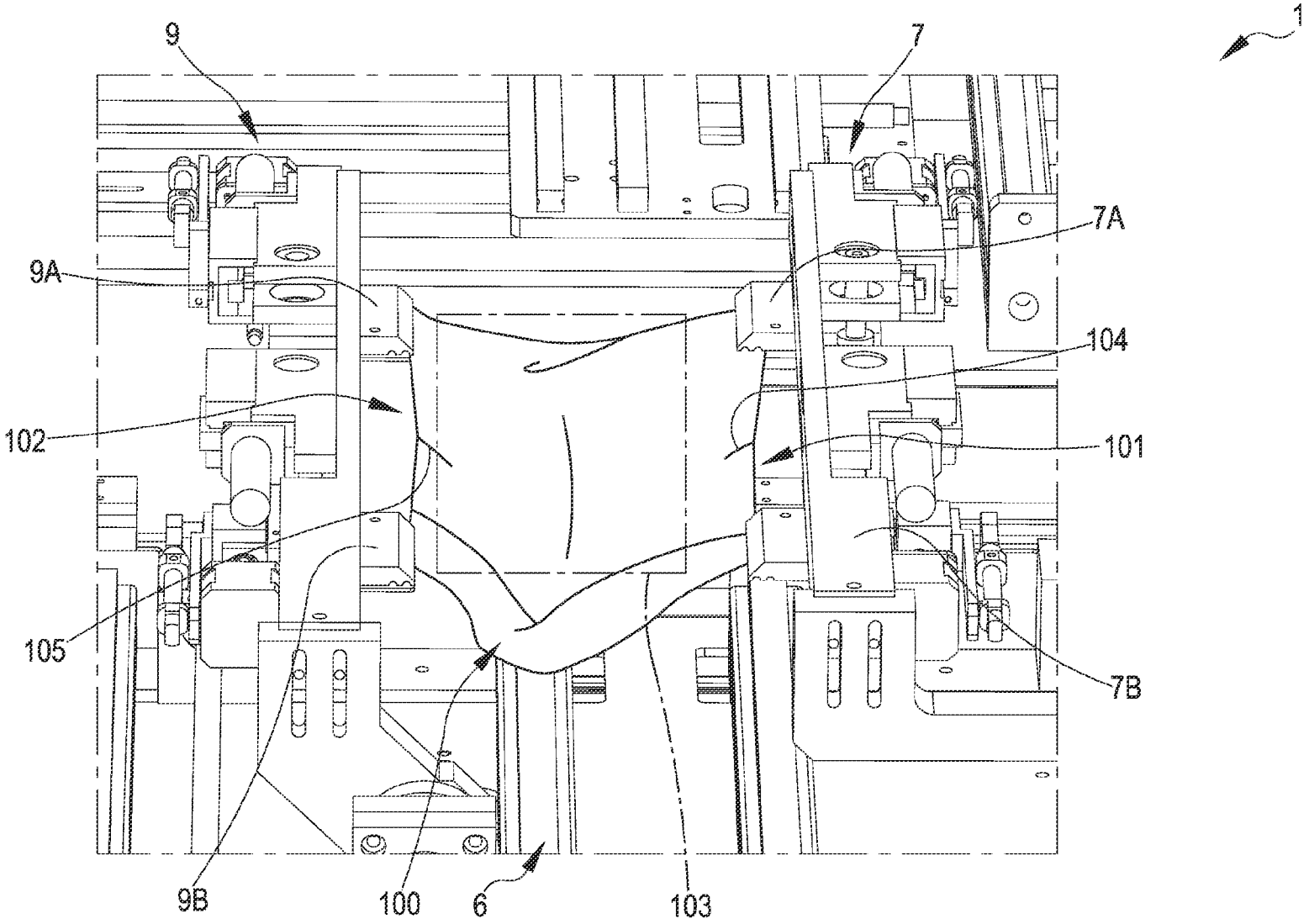
FIG. 5 is a perspective view of the handling station of the machine of FIG. 1, showing an operating configuration in which the second edge portion of the first end of the first tubular fabric has been moved to the same height as the first edge portion of the first end of the first tubular fabric.

Similarly to the first take-up device 7, in order to handle the tubular fabric 100 the second take-up device 9 comprises a first gripper 9A and a second gripper 9B. The first gripper 9A and the second gripper 9B of the second take-up device 9 can be similar from a structural and functional point of view to the first gripper 7A and to the second gripper 7B of the first take-up device 7; the accompanying figures show this embodiment. The presence of a pair of grippers 9A, 9B allows the second take-up device 9 to handle in a simple and highly accurate manner the second edge portion 102 of the first end 100A of the tubular fabric 100. The first gripper 9A and the second gripper 9B of the second take-up device 9 are configured for catching the second edge portion 102 of the first end 100A of the tubular fabric 100 on or near respective end segments 102B, 102C. The first gripper 9A and the second gripper 9B of the second take-up device 9 are supported by the movable crossbar and can shift, by means of the first moving mechanism 10, integrally with the movable crossbar along the first direction. The first gripper 9A and the second gripper 9B of the second take-up device 9 are further movable with respect to the movable crossbar along the second direction transversal to the first direction parallel to the first gripper 7A and to the second gripper 7B of the first take-up device 7; in the embodiment shown in the accompanying figures, the second direction is orthogonal to the first direction and is basically parallel to a main direction of extension of the movable crossbar and of the movable arm. In other terms, the first gripper 9A and the second gripper 9B of the second take-up device 9 can move along the movable crossbar, which basically acts as a rail for the first gripper 9A and the second gripper 9B of the second take-up device and can shift in its turn along the first direction in accordance with the above description. The first gripper 9A and the second gripper 9B of the second take-up device 9 can move along the second direction getting away from and approaching one another; by way of example, in order to enable the movement of the first gripper 9A and of the second gripper 9B, the second take-up device 9 can include a dedicated motor element for each gripper 9A, 9B or one motor element equipped with suitable kinematic systems for mutually moving the grippers 9A, 9B getting away from or approaching one another. In accordance with the embodiment shown in the accompanying figures, the first gripper 9A and the second gripper 9B of the second take-up device 9 are mutually arranged, in the same operating configuration, at the same height; as shall be seen below, the height of the first gripper 9A and of the second gripper 9B of the second take-up device 9 can vary depending on the specific operating configuration taken by the second take-up device 9. The first gripper 9A and the second gripper 9B of the second take-up device 9 are configured for operating between a second height, or catching height, and an operating height. The second height is a height at which the first gripper 9A and the second gripper 9B of the second take-up device 9 catch the second edge portion 102 of the first end 100A of the tubular fabric 100; the second height is smaller than the first height. In other words, when the second take-up device 9 catches the second edge portion 102, the first gripper 9A and the second gripper 9B are arranged at the same height, i.e. the second height, below the first gripper 7A and the second gripper 7B of the first take-up device 7, which are arranged at the first height and catch, in operating conditions of the machine 1, the first edge portion 101 at the first height; this operating condition is shown in FIGS. 3 and 4. After the catching operation, the first gripper 9A and the second gripper 9B of the second take-up device 9 are configured for moved from the second height to the operating height. In the embodiment shown in the accompanying figures, the operating height coincides with the first height at which the grippers 7A, 7B of the first take-up device 7 are placed; see for this FIG. 5. In other words, the first gripper 9A and the second gripper 9B of the second take up device 9 can be supported at the same height as the first gripper 7A and the second gripper 7B of the first take-up device 7. Supporting the first gripper 9A and the second gripper 9B of the second take up device 9 at the same height as the first gripper 7A and the second gripper 7B of the first take up device 7, allows the handling station 6 to define the operating configuration in which the first take-up device 7 and the second take-up device 9 defined an intermediate operating area 103 therebetween. Moreover, in operating conditions of the machine 1 in which each take-up device 7, 9 catches the respective edge portion 101, 102 of the first end 100A of the tubular fabric 100, supporting the first gripper 9A and the second gripper 9B of the second take up device 9 at the same height as the first gripper 7A and the second gripper 7B of the first take up device 7 allows the handling station 6 to position the second edge portion 102 at the same height as the first edge portion 101. This positioning allows the first take-up device 7 and the second take-up device 9 to take an operating condition in which they mutually face each other and, as a result, the first edge portion 101 faces the second edge portion 102 and they define therebetween the intermediate operating area 103; this operating configuration is shown in FIG. 5. In particular, in said operating configuration, the first gripper 7A of the first take-up device 7 faces the first gripper 9A of the second take-up device 9, and the second gripper 7B of the first take-up device 7 faces the second gripper 9B of the second take-up device 9. In further possible embodiments, the first take-up device 7 and the second take-up device 9 can be configured for defining an operating configuration in which they face each other so as to define an intermediate operating area, and as a result the first edge portion 101 and the second edge portion 102 of the first end 100A of the tubular fabric 100 face each other, at different heights; in order to achieve this operating configuration, the control unit can move at least one of the first take-up device 7 an the second take-up device 9, or both, e.g. at different heights.

The movement of the first gripper 9A and the second gripper 9B of the second take up device 9 from the second height to the first height can occur by rotating or tilting the movable crossbar supporting the first gripper 9A and the second gripper 9B.

In order to move the second take-up device 9 so as to shift the first gripper 9A and the second gripper 9B from the second height to the operating height, the machine includes a third moving mechanism 11. The third moving mechanism 11 is configured for allowing, in operating conditions of the machine 1, the first gripper 9A and the second gripper 9B of the second take up device 9 to be moved from a starting configuration, which can be the catching configuration in which they catch the second edge portion 102, to the operating condition in which the face the first gripper 7A and the second gripper 7B of the first take-up device 7. In the embodiment shown in the accompanying figures, the third moving mechanism 11 acts upon the movable crossbar and allows the second take-up device 9 to be moved by rotating the movable crossbar. The rotation of the movable crossbar takes place with reference to the first take-up device 7 and aims at moving the first gripper 9A and the second gripper 9B of the second take up device 9 to the first height, which is the operating height. The rotation of the movable crossbar can occur along an arc of circumference with an angular width of 90° to 270°; in particular, the angular width of the arc of circumference described by the movable crossbar can be of 150° to 210°. Optionally, the angular width of the arc of circumference described by the movable crossbar can be basically of 180° so as to enable the movable crossbar and thus of the first gripper 9A and of the second gripper 9B supported by the latter to be tilted. The angular width of the arc of circumference described by the movable crossbar can vary depending on the second height, on the initial position of the grippers 9A, 9B of the second take-up device 9, on the first height and on the final position desired for the grippers 9A, 9B of the second take-up device 9, to be achieved by means of rotation. By way of example, in order to enable the rotation of the movable crossbar, the third moving mechanism 11 can include a motor element operatively connected to the movable crossbar by means of suitable kinematic systems allowing the rotation of the movable crossbar. These kinematic systems can include for instance a track apt to turn its linear motion into a rotational motion of the movable crossbar and thus of the first gripper 9A and of the second gripper 9B of the second take up device 9 engaged thereto. These kinematic systems can further include a toothed wheel or pinion engaged, either directly or indirectly, to the movable crossbar and configured for rotating, during the shift of the rack, with respect to the rack so as to draw the crossbar into rotation. Beyond the rack and the toothed wheel, the third moving mechanism 11 can comprise, as far as the kinematic systems are concerned, also a telescopic guide supporting the shift of the rack. In other embodiments, the third moving mechanism 11 can include further or different kinematic system apt to cause the rotation of the movable crossbar. In other possible embodiments, the third moving mechanism 11 can include suitable kinematic systems configured for moving the movable crossbar, and thus the first gripper 9A and the second gripper 9B of the second take up device 9, to the operating height by a vertical shift of the movable crossbar; in these embodiments, a suitable combination of the horizontal shift of the movable crossbar along the first direction, which is allowed by the motor element of the second moving mechanism 10, and of the shift of the movable crossbar along the vertical direction, which is allowed by the third moving mechanism 11, allows the machine 1 to move the first gripper 9A and the second gripper 9B of the second take up device 9 to the operating height. The combination of the aforesaid shifts can occur under the management and control exerted by the control unit. In further possible embodiments, the first gripper 9A and the second gripper 9B of the second take up device 9 can be moved to the operating height by a suitable rotational shift of the movable crossbar; the rotational shift can be managed and controlled by the control unit. The machine 1 further comprises a cutting station 12. The cutting station 12 is configured for creating a first cut or vent 104 on the tubular fabric 100 on the middle segment 101A of the first edge portion 101, and a second cut or vent 105 on the tubular fabric on the middle segment 102A of the second edge portion 102. Below reference will be made, for the sake of simplicity, to cuts or vents 104, 105 using the term "vents". The cutting station 12 creates the vents 104, 105 so that each vent 104, 105 defines a respective first piece 104A, 104B and a respective second piece 105A, 105B on the respective middle segment 101A, 102A. Each vent 104, 105 has a smaller longitudinal extension, defined parallel to the direction of axial development of the tubular fabric 100, than a length of the tubular fabric 100; the length of the tubular fabric 100 is defined along the direction of axial development as the distance between the first end 100A and the second end 100B of the tubular fabric 100. The first vent 104 and the second vent 105 preferably have the same longitudinal extension. The ratio of the longitudinal extension of each vent 104, 105 to the length of the tubular fabric can be between 0.1 and 0.7, in particular between 0.2 and 0.6, optionally between 0.3 and 0.5. In possible alternative embodiments, the machine 1 can include a cutting station 12 configured for creating only one of the first vent 104 and the second vent 105; in these embodiments pre-cut or pre-vented tubular fabrics can be loaded into the machine, already equipped with a vent 104, 105 when they are positioned on the first loading station 3. In further possible embodiments, the machine 1 can be without a cutting station 12 and pre-cut or pre-vented tubular fabrics 100 can be loaded into the machine 1, i.e. already provided both with the first vent 104 and with the second vent 105 when they are positioned on the first loading station 3. The embodiment of the machine 1 shown in the accompanying figures shall now be described; in this embodiment, the cutting station 12 includes a cutting device configured for creating the first vent 104 and the second vent 105 on the first edge portion 101 and on the second edge portion 102, respectively, of the first end 100A of the tubular fabric 100. The cutting device is equipped with a cutting element 12A and with a supporting element 12B carrying the cutting element 12A. The accompanying figures show an embodiment in which the supporting element is an elongated bar 12B, to whose end the cutting element 12A is engaged. As shown in FIG. 3, the cutting element can be a pair of scissors 12A; similarly, possible variations may include equivalent cutting elements, such as a blade or a cutter or a guillotine, which can be suitably moved with respect to the first tubular fabric so as to create the vents 104, 105. The cutting device can further include a motor element engaged to the supporting element and configured for moving, under the supervision and the control exerted by the control unit, the supporting element 12B, and thus the cutting element 12A carried by the latter, between the first take-up device 7 and the second take-up device 9, and therefore between the first height and the second height at which they are placed respectively when creating the vents 104, 105. The operating configuration before the creation of the vents 104, 105 is shown in FIG. 3, which shows the cutting element 102A carried by the supporting element 102B close to the tubular fabric 100. FIG. 4, conversely, shows the operating configuration after the creation of the vents 104, 105. The motor element is operatively connected to the supporting element 102B by means of suitable kinematic systems, which allow the supporting elements 102B to shift in vertical direction between the first take-up device 7 and the second take-up device 9 and thus between the first height and the second height. By way of example, the cutting device can include, as far as kinematic systems are concerned, a telescopic guide apt to help the movement in vertical direction of the cutting element 12A. The fact that the cutting element 102A can be moved between the first height and the second height allows, in operating conditions of the machine 1, to create the first vent 104 and the second vent 105 by one cutting element 12A only. In possible alternative embodiments, the cutting station 12 can include two distinct cutting devices or two distinct cutting elements 12A, each of them can be dedicated to the creation of a respective vent 104, 105. The movement of the supporting element 12B and thus of the cutting element 12A is suitably managed and controlled by the control unit.

The cutting station 12 can be further equipped with a guiding mechanism carrying the supporting element 12B, and with a dedicated motor element configured for moving the guiding mechanism, and thus the supporting element 12, close to or away from the handling station; this movement can occur along a horizontal direction basically parallel to the first direction. The motor element is operatively connected to the guiding mechanism by means of suitable kinematic systems for moving the guiding mechanism, such as at least one toothed wheel, and, in addition or as an alternative, a rack or a belt. The guiding mechanism can be a shuttle or a slide.

Until now stations defining a forward path of the tubular fabric 100 along the machine 1 and configured for performing specific steps on a first tubular fabric 100, have been described in detail; these steps are designed to manufacture a pair of boxers B.

In order to manufacture a pair of boxers B, the machine 1 provides for the use of a second tubular fabric 200, separated from the first tubular fabric 100 described above. The second tubular fabric 200, similarly to the first tubular fabric 100, has a first end 200A and a second end 200B, opposed to one another, between which a fabric coat delimiting a tubular duct develops. Each end 200A, 200B has an edge delimiting a hollow access port for the access to the tubular duct. Moreover, the second tubular fabric 200 has two inner seams developing on an inner surface of the coat delimiting the tubular duct; each inner seam S' develops near a respective end of the second tubular fabric 200. These inner seams develop circumferentially around the direction of axial development of the second tubular fabric 200 and are obtained before loading the second tubular fabric 200 into the machine 1; they can be obtained for instance by means of a circular knitting machine for knitted or hosiery items with which the tubular fabric 200 is manufactured.

The second tubular fabric 200 and the first tubular fabric 100, which are the starting fabrics for manufacturing boxers B by means of the machine 1, are obtained by means of a circular knitting machine for knitted or hosiery items. In particular, the second tubular fabric 200 and the first tubular fabric 100 are obtained with the same type of knitting machine or the same circular knitting machine for knitted or hosiery items. The second tubular fabric 200 and the first tubular fabric 100 are preferably made of the same fabric; however, in alternative embodiments, boxers can be manufactured starting from tubular fabrics 100, 200 made of different fabrics. The second tubular fabric 200 and the first tubular fabric 100 can be different due to at least one geometrical feature, e.g. one of: length, width, diameter, etc. The second tubular fabric 200 can have a smaller length, defined like the distance between the first end 200A and the second end 200B, than the length of the first tubular fabric 100; in addition or as an alternative, the second tubular fabric 200 can have a larger diameter than a diameter of the first tubular fabric 100. The diameter of each tubular fabric 100, 200 can be measured at an end 100A, 100B, 200A, 200B or a central portion of the coat placed between the ends 100A, 100B, 200A, 200B.

The machine further comprises a second loading station 13 onto which at least a second tubular fabric 200 or a stack of second tubular fabrics 200 can be loaded. As shall be seen in further detail below, loading at least a second tubular fabric 200, and in particular loading a stack of second tubular fabrics 200, allows the machine 1 to implement a plurality of productive cycles, each aiming at manufacturing a pair of boxers B, so as to manufacture a series of boxers B one pair after the other. For instance, the machine 1, under the supervision of the control unit, can start a second productive cycle while a productive cycle is still taking place and is not completed yet; thus the machine 1 can perform at least two productive cycles at the same time. The second loading station 13 can include a loading plate onto which at least a second tubular fabric 200 or a stack of second tubular fabrics 200 can be loaded. Optionally, the loading plate can move vertically with respect to the frame 2, so as to be raised or lowered with respect to a floor of the frame 2. The second tubular fabrics 200 can be loaded onto the second loading station 13 manually, e.g. by an operator preparing or monitoring the machine 1. In addition or as an alternative, the second tubular fabrics 200 can be loaded onto the second loading station 13 in an automated manner, e.g. by means of an automated or robot arm. As described above, the second tubular fabrics 200 thus loaded can be manufactured with a circular knitting machine for knitted or hosiery items. In other words, the second tubular fabrics 200 can come from a circular knitting machine for knitted or hosiery items, e.g. from the same type of knitting machine or from the same knitting machine as the one with which the first tubular fabrics 100 are manufactured.

The machine 1 further comprises a second pick-up station 14 configured for picking up at least a second tubular fabric 200 from the second loading station 13. In the embodiment shown in the accompanying figures the second pick-up station 14 is arranged above the second loading station 13 and is configured for picking up a tubular fabric 200, e.g. from the loading plate; to this purpose, the second pick-up station 14 is provided with a suction head which is vertically movable approaching or away from the loading plate. Under the supervision of the control unit, the suction head of the second pick-up station 14 is configured for approaching the loading plate, picking up a second tubular fabric 200, e.g. from the stack of second tubular fabrics 200 and lift the second tubular fabric 200 while getting away from the loading plate.

The machine 1 further comprises a separating station 15 arranged downstream from the second pick-up station 14 and configured for separating a fabric element 201 from the second tubular fabric 200. The fabric element 201 can be basically a strip or length of fabric which can be separated from the second tubular fabric 200 as shall be described below. The accompanying figures show a separating station 15 configured for allowing the separation of a plurality of fabric elements 201 from the second tubular fabric 200. In alternative embodiments, the machine 1 can be without a separating station 15 and at least one or a plurality of fabric elements 201 can be loaded onto the second loading station 13; these fabric elements 201 can be separated e.g. from at least a second tubular fabric (e.g. obtained and manufactured by a circular knitting machine for knitted or hosiery items) before being loaded into the machine 1.

The separating station 15 shown in the embodiments as in the accompanying figures, which acts upon the second tubular fabric 200 so as to separate from the latter a plurality of fabric elements 201, is described below.

Figure 6:
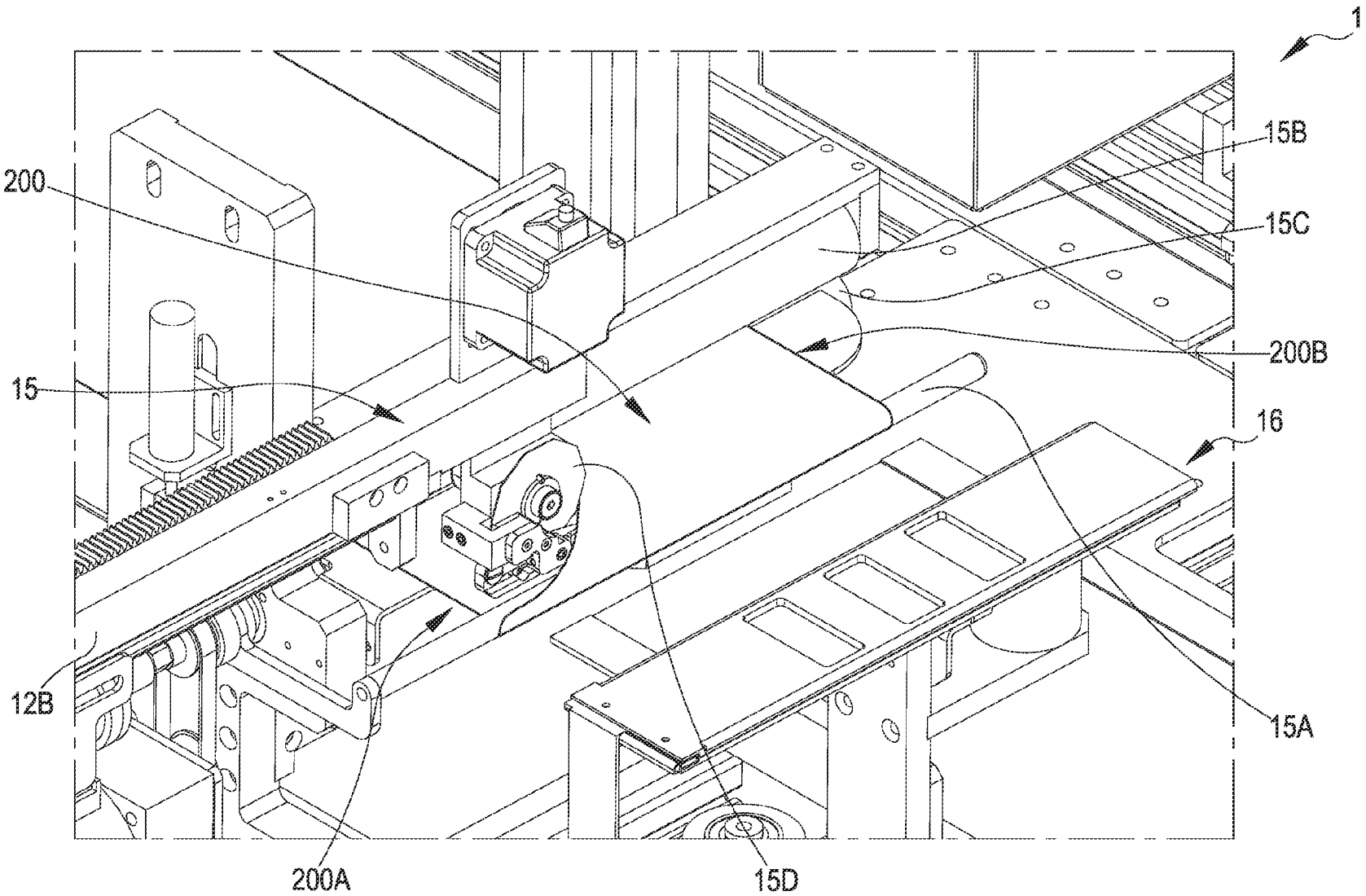
FIG. 6 is a perspective view of the separating station of the machine of FIG. 1 during a first cutting operation of a second tubular fabric.

The separating station 15 comprises a positioning device configured for positioning the second tubular fabric 200 picked up by the second pick-up station 14. The positioning device comprises a pair of spreading bars 15A configured for spreading the second tubular fabrics 200 so as to stretch and/or tension it in a suitable manner. The positioning device comprises a blocking element 15B configured for blocking the second tubular fabric 200, e.g. by exerting a pressure onto the second tubular fabric 200. The positioning device can further comprise an abutment element 15C apt to provide an abutment surface for the blocking element 15B; in an operating configuration, a portion of the second tubular fabric 200 is placed between the stop element and the blocking element (see FIG. 6). In the embodiment show in the accompanying figures, the blocking element is a pressure roll 15B and the abutment element is an abutment roll 15C apt to provide an abutment surface for the pressure roll 15B. The operating configuration in which the tubular fabric 200 is spread and tensioned by the spreading bars 15A and is blocked by the pressure roll 15B is shown in FIG. 6. The positioning device allows to arrange the second tubular fabric 200, by positioning and tensioning it as described above, in such a configuration as to make it easier for a cutting element 15D of the separating station 15 to cut.

Figure 7:
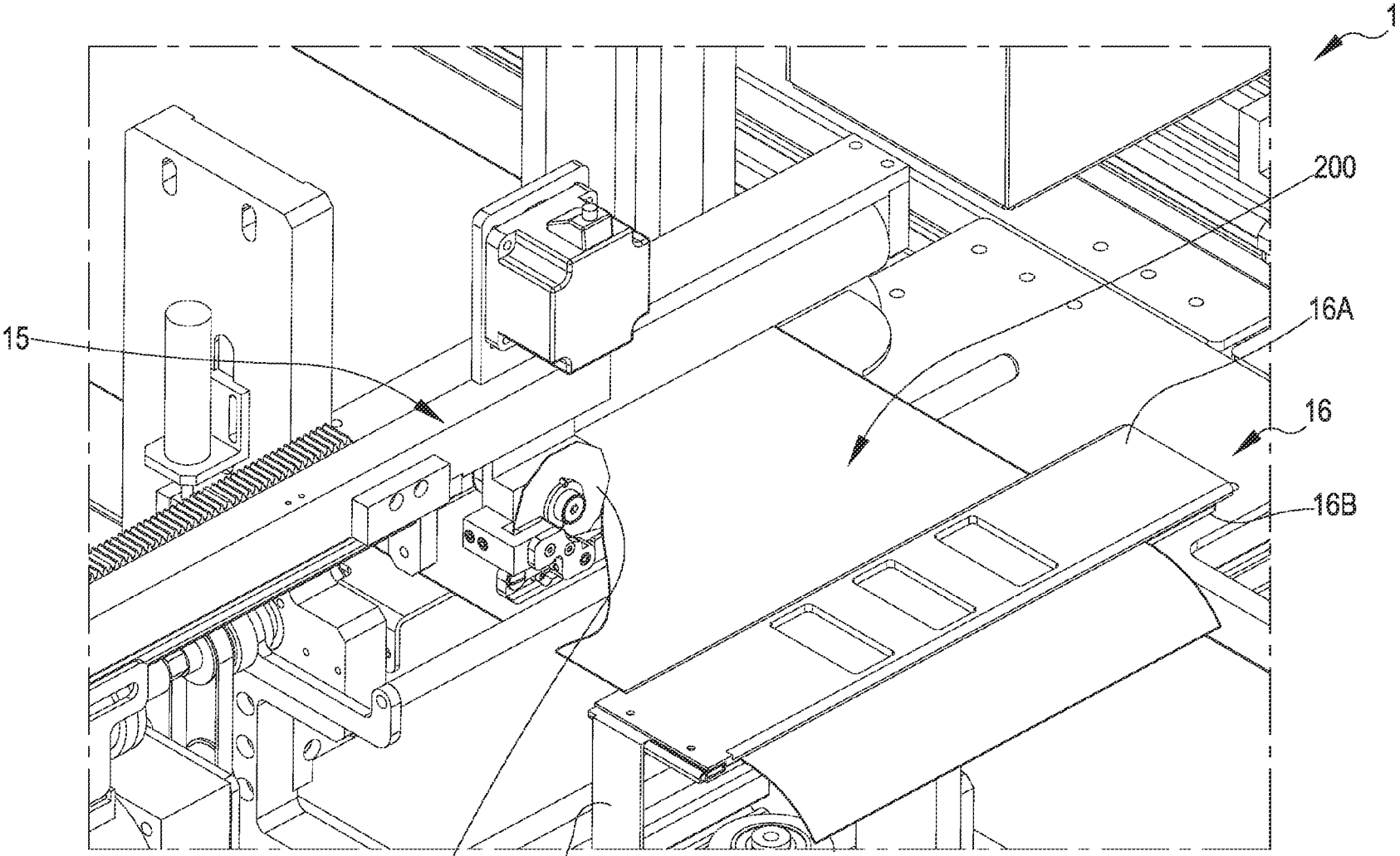
FIG. 7 is a perspective view of the separating station of the machine of FIG. 1 during a second cutting operation of the second tubular fabric for removing a fabric element from the second tubular fabric.

As shown in FIG. 6, the cutting element 15D is included in the separating station and is configured for cutting the second tubular fabric 200 so as to separate fabric elements 201. In order to be able to cut the second tubular fabric 200 so as to separate fabric elements 201 from the latter, the cutting element 15D is configured for being shifted with respect to the second tubular fabric 200 blocked by the blocking element 15B; this operating configuration is shown in FIGS. 6 and 7. The cutting element 15D can be shifted by an arm which the cutting element 15D is integral with; the arm can be included in the separating station 15. In the embodiment as in the accompanying figures, the cutting element is a rotating blade 15D carried by an arm that can be shifted with respect to the frame and, in operating conditions, with respect to the second tubular fabric 200 blocked by the pressure roll 15B; in possible variants, the cutting element 15D can be a pair of scissors or a cutter or a guillotine. The cutting element 15D is configured for executing at least one cutting operation on the second tubular fabric, as described below with reference to two possible starting configurations of the second tubular fabric 200, which are preliminary to a separation of a first fabric element 201 or of a further fabric element 201.

In a first starting configuration, the second tubular fabric 200 can be intact, i.e. not yet subjected to a separating operation. In this case the separation of a first fabric element 201 from the second tubular fabric 200 occurs with two cutting operations. In a first cutting operation, the cutting element 15D cuts and opens the coat of the second tubular fabric 200. The first cutting operation aims at creating a cut whose depth is basically the same as the length of the second tubular fabric 200; thus the second tubular fabric 200 loses its tubular shape and basically becomes a fabric rectangle. An example of intact second tubular fabric 200 is a second tubular fabric 200 that has just been picked up from the second loading station 13 and that should still be subjected to a cutting operation. FIG. 6 shows the separating station 15 which, by means of the cutting element 15D, executes the first cutting operation on the second tubular fabric 200. Now the second tubular fabric 200 that has taken the shape of a fabric rectangle due to the first cutting operation, is suitably blocked and positioned by means of a moving device 16 and is ready to undergo a second cutting operation by the cutting element, as shown in FIG. 7. Similarly to the first cutting operation, the second cutting operation aims at creating a cut whose depth is basically the same as the length of the second tubular fabric 200; thus the second cutting operating allows to remove a fabric element 201 from the second tubular fabric 200.

In a second starting configuration, the second tubular fabric 200 may already have been subjected to one or more cutting operations and to one or more separating operations. In other words, in the second starting configuration the second tubular fabric 200 is already in the shape of a fabric rectangle, e.g. since a fabric 201 has already been separated from it. In this case, i.e. if the separating station 15 receives a second incoming tubular fabric 200 already in the shape of a fabric rectangle, the cutting element 15D removes a fabric element 201 by means of one cutting operation. From the point of view of the graphical representation, the second starting configuration is similar to an intermediate condition between the first cutting operation and the second cutting operation of the first starting configuration (see FIG. 6).

The control unit can monitor the separating station 15 so that it separates fabric elements 201 from the second tubular fabric 200 basically up to a condition in which the second tubular fabric 200 does not show any longer a fabric surface sufficient to separate a further fabric element 201; now the control unit can drive the second pick-up station 14 to pick up a further second tubular fabric 200 from the second loading station 13.

The fabric element 201 can have a globally polygonal shape and be provided with a first side edge 201A and with a second side edge 201B, which is opposed and basically parallel to the first side edge 201A. The fabric element 201 is further provided with a first transversal edge 201C and with a second transversal edge 201D, which is opposed and basically parallel to the first transversal edge 201C. The transversal edges 201C, 201D can be basically orthogonal to the side edges 201A, 201B. In the embodiment as in the accompanying figures, the fabric element 201 is a strip or piece of fabric with a basically rectangular shape; for this see in particular FIGS. 8 and 11A. The fabric element 201 separated from the second tubular fabric 200 has two pieces S' of the inner seams of the second tubular fabric 200, which are placed on a surface of the fabric element 201 designed to be an inner surface of the pair of boxers B. Each seam piece S' is designed to be moved, after being joined to the first tubular fabric 100 as shall be explained below, to a respective hollow portion of the pair of boxers B. Each of the two seam pieces S' of the fabric element 201, which shall be referred to below as inner seams S' of the fabric element 201, develops near a respective transversal edge 201C, 201D of the fabric element (see FIG. 11B).

The machine 1 further includes a moving device 16 configured for moving the fabric element 201 downstream from the separating station 15.

The moving device 16 can comprise a blocking mechanism 16A configured for blocking the second tubular fabric 200 so as to allow an optimal cutting operation for removing the fabric element 201. In the embodiment show in the accompanying figures, the blocking mechanism is a blocking plate 16A, which can be rotated with respect to a base plate 16B of the moving device 16; the rotation of the blocking plate 16A allows it to be lifted with respect to the base plate 16B and to position a portion of the second tubular fabric 200, e.g. an end portion thereof, between the blocking plate 16A and the base plate 16B. The configuration in which a portion of the second tubular fabric 200 is arranged between the blocking plate 16A and the base plate 16B is shown in FIG. 7. The rotation of the blocking plate 16A can take place by exerting a thrust, e.g. by means of a piston, onto an actuating flange 16C of the moving device 16 engaged to the blocking plate 16A; in the embodiment as in the accompanying figures (see in particular FIGS. 6 and 7), the actuating flange 16C develops orthogonally to a main surface of development of the blocking plate 16A. The blocking mechanism 16A is further configured for blocking the fabric element 201 during the movement of the fabric element along the machine, e.g. along a fabric element path that shall be described below (see FIGS. 8, 9 and 10).

As shown in the accompanying figures, the moving device 16 is configured for moving the fabric element in an operating configuration in which the fabric element 201, which has been separated according to the previous description, is connected to the blocking mechanism 16A. The moving device 16 can be suitably powered; to this purpose the moving device 16 can be powered and the machine 1 can include a motor element operatively connected to the moving device 16 for enabling the motion thereof. The movement of the fabric element 201 by the moving device can be suitably managed and controlled by the control unit. In the accompanying figures, the moving device is a slide 16; in alternative embodiments, the moving device 16 can be any device apt to allow the fabric element to be moved, such as a carriage or a slide.

As described above, the machine 1 includes dedicated stations for handling the first tubular fabric 100 and dedicated station for handling the second tubular fabric 200; the stations define respective forward paths of the first tubular fabric 100 and the second tubular fabric 200 along the machine 1. The forward paths of the first tubular fabric 100 and of the second tubular fabric 200 (and of the fabric element 201 separated from it) along the machine 1 can be outlined or represented by directions transversal to one another. The forward direction of the second tubular fabric 200 (and of the fabric element 201 separated from it) along the machine 1 can be transversal to the forward direction of the first tubular fabric 100 along the machine 1. The accompanying figures show an embodiment in which the frame 2 of the machine 1 is basically "L"-shaped and in which the forward direction of the first tubular fabric 100 is globally defined on the longer segment of the "L", and the forward direction of the second tubular fabric 200 (and of the fabric element 201 separated from it) is globally defined on the shorter segment of the "L"; both forward directions, and thus both forward paths of the first tubular fabric 100 and of the second tubular fabric 200 (and of the fabric element 201 separated from it), converge to a junction of the "L" on which the machine exhibits a sewing station 17. FIG. 1 shows the shape basically as an "L" of the frame 2 of the machine 1 and the arrangement of the stations along the segments of the "L". The presence of the sewing station 17 on the junction of the forward paths is particularly advantageous since it allows to optimize and rationalize the arrangement of the stations on the frame 2 of the machine 1, and allows to obtain a compact machine whose overall size is minimized. It is however obvious that in possible alternative embodiments, the sewing station 17 can be placed on other portions of the machine 1.

The sewing station 17 is configured for sewing together the fabric element 201 and the first tubular fabric 100 so as to obtain boxers B. So as to execute the necessary seams in order to obtain the pair of boxers B, the sewing station 17 is provided with a sewing machine 18; the sewing machine 18 is suitably fed with at least one yarn. The sewing machine 18 is configured for sewing the fabric element 201 so that a first seam BS1 joins the second longitudinal edge 201B of the fabric element 201 to the first piece 105A and to the second piece 105B of the middle segment 102A of the second edge portion 102 of the first tubular fabric 100, and so that a second seam BS2 joins the first longitudinal edge 201A of the fabric element 201 to the first piece 104A and to the second piece 104B of the middle segment 101A of the first edge portion 101 of the first tubular fabric 100 (see FIG. 11A). In order to obtain said seams BS1, BS2 the control unit controls the handling station 6 and the moving device 16 so that they operate in a sequence of operating positions defined around the sewing machine 18 so as to move, in operating conditions of the machine 1, the first tubular fabric 100 and the fabric element 201 in a sequence of respective operating positions also defined around the sewing machine 18.

Figure 8:
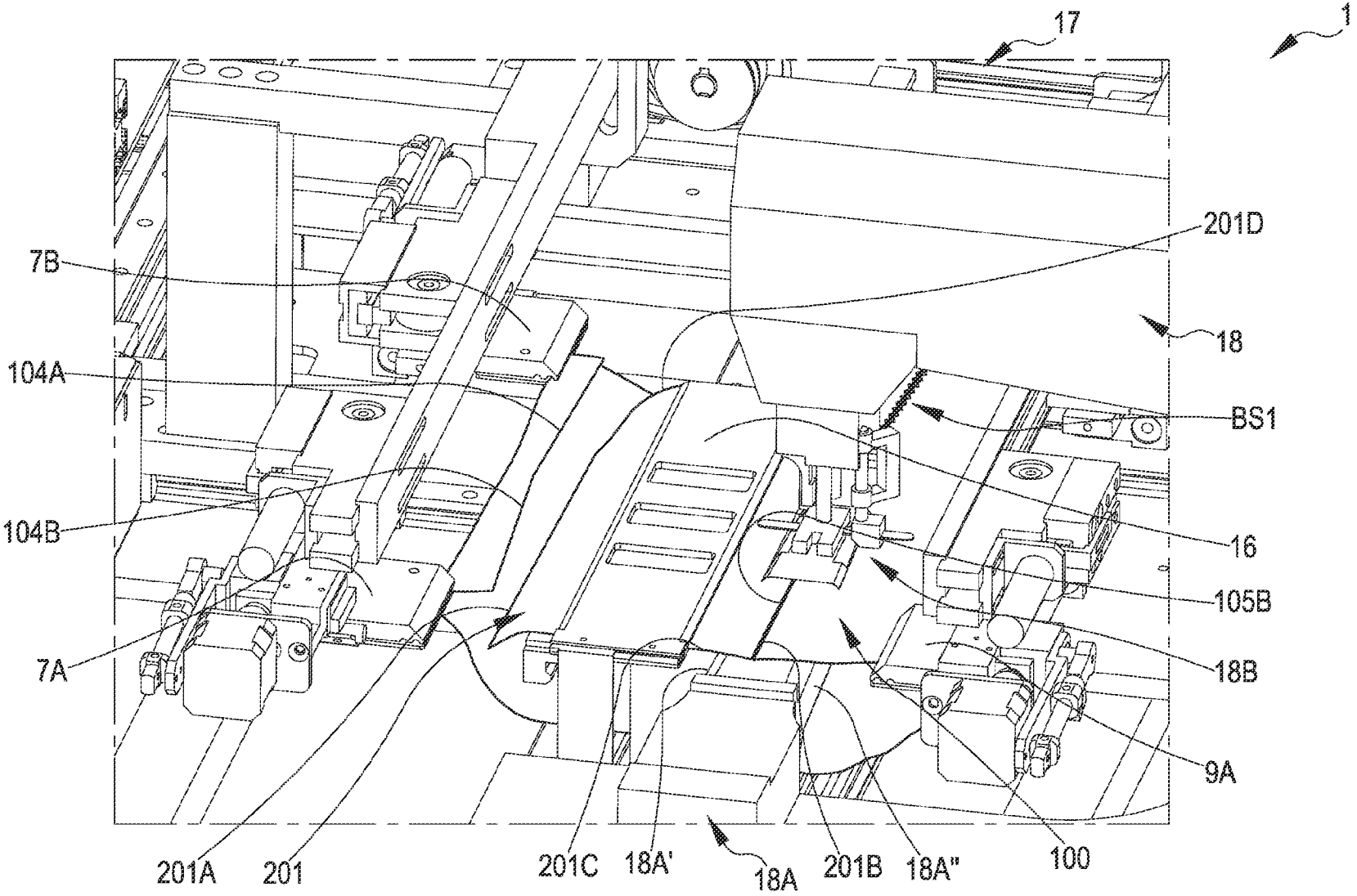
FIG. 8 is a perspective view of the sewing station of the machine of FIG. 1 while sewing a longitudinal edge of the fabric element, carried by a moving device, to the middle segment of an edge portion of the first end of the first tubular fabric.
Figure 9:
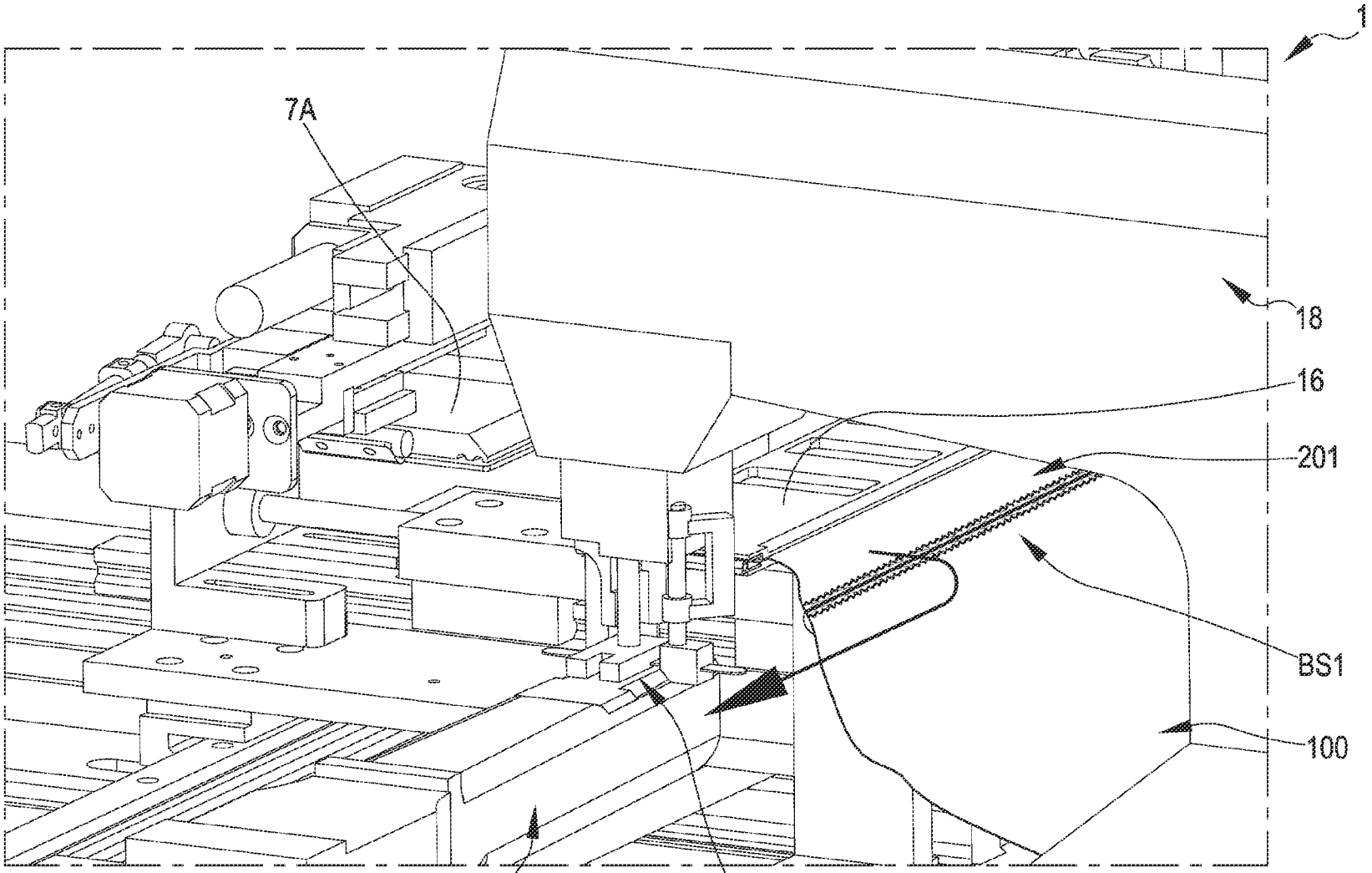
FIG. 9 is a perspective view of the sewing station of the machine of FIG. 1, showing a segment of a fabric element path along which the moving device moves the fabric element around the base of the sewing machine.
Figure 10:
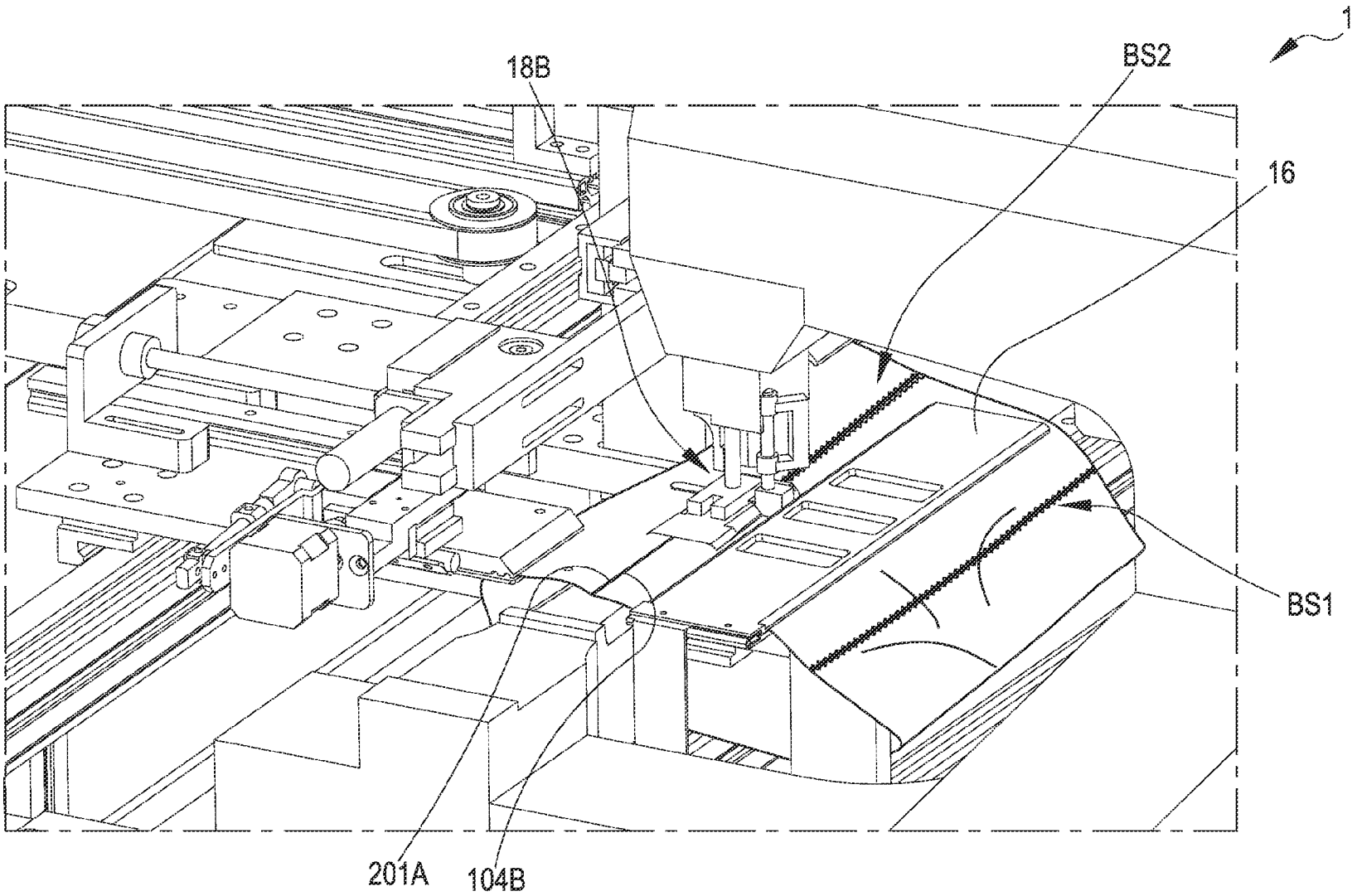
FIG. 10 is a perspective view of the sewing station of the machine of FIG. 1 while sewing a further longitudinal edge of the fabric element, carried by the moving device, to the middle segment of a further edge portion of the first end of the first tubular fabric.

The sewing machine 18 comprises a base 18A and a sewing head 18B; in the embodiment as in the accompanying figures, the sewing head 18B is arranged at a greater height than the base 18A (see FIGS. 8 to 10). The base 18A is provided with a first side 18A' and with a second side 18A" opposed to one another; the sides 18A', 18A" connect to each other on a connecting portion of the base 18A. The base 18A defines a first operating area defined laterally with respect to the first side, and a second operating area defined laterally with respect to the second side; the operating areas are opposed to one another with respect to the base. The first tubular fabric 100 and the fabric element 201 are moved in the operating areas synchronously and, after the first seam BS1 is created, integrally; during the movement of the first tubular fabric 100 and of the fabric element 201, the sewing head 18B sews as described below.

The sewing head 18B is configured for sewing both on a first sewing area that is close and beside the first operating area, and on a second sewing area that is close and beside the second operating area.

In order to create the seams, the control unit is designed to drive the first take-up device 7, the second take-up device 9 and the moving device 16 in a sequence of respective operating positions defined around the base 18A of the sewing machine 18 so as to move, in operating conditions of the machine 1, the first tubular fabric 100 and the fabric element 201 in a sequence of operating positions defined around the base 18A of the sewing machine 18. Moreover, the control unit is designed to manage the movement of the first tubular fabric 100 and of the fabric element 201 according to a positioning relation between the sequence of operating positions of the first take-up device 7, the sequence of operating positions of the moving device 16 and, for at least one segment of the path of the first tubular fabric 100 around the base of the sewing machine 18, the sequence of operating conditions of the second take-up device 9. The positioning relations is such as to allow the sewing head 18B to sew the first longitudinal edge 201A of the fabric element 201 to the first edge portion 101 of the first end 100A of the first tubular fabric 100, and the second longitudinal edge 201B of the fabric element 201 to the second edge portion 102 of the first end 100A of the first tubular fabric 100. The control unit is designed to drive the sewing machine 18 so as to sew, on the first sewing area, the first longitudinal edge 201A of the fabric element 201 to the first piece 104A and to the second piece 104B of the first vent 104. The control unit is further designed to drive the sewing machine so as to sew, on the second sewing area, the second longitudinal edge 201B of the fabric element 201 to the first piece 105A and to the second piece 105B of the second vent 105. Thus the first seam BS1 of the second longitudinal edge 201B of the fabric element 201 to the middle segment 102A of the second edge portion 102 of the first end 100A of the first tubular fabric 100, and the second seam BS2 of the first longitudinal edge 201A of the fabric element 201 to the first piece 105A and to the second piece 105B of the middle segment 101A of the first edge portion 101 of the first end 100A of the tubular fabric 100, are obtained along respective sewing lines that are basically rectilinear and, in at least one finished configuration of the pair of boxers, basically parallel (see FIG. 11A).

A possible movement of the moving device 16, of the first take-up device 7 and of the second take-up device 9 is described below in detail, which can be implemented by the machine 1 according to the embodiment as in the accompanying figures, including a slide as a moving device 16. The movement of the first take-up device 7 and of the second take-up device 9 is monitored and managed by the control unit, which moves these take-up devices 7, 9 by suitably driving the first moving mechanism 8, the second moving mechanism 10 and the third moving mechanism 11. This movement is further implemented by the method for manufacturing boxers B that shall be described below and can therefore be applied mutatis mutandis to the method according to the invention. In operating conditions of the machine 1, the slide 16 moves the fabric element 201 along a fabric element path; this path can be further defined as a fabric element sewing path since it is the path along which the fabric element 201 is sewn by the sewing head 18B to the first tubular fabric 100 so as to obtain the pair of boxers B. For the sake of simplicity, this path shall be referred to below as the fabric element path. The fabric element path comprises a first segment placed beside the first side 18A' of the base 18A and defined on the first operating area, a second segment that is consecutive and at least partially transversal to the first segment, a third segment that is consecutive and at least partially transversal to the second segment and defined on the second operating area. The second segment can be at least partially curved, whereas the third segment is basically parallel to the first segment and is basically as long as a the first segment. The first segment, the second segment and the third segment define a fabric element path basically shaped as a "U" around the base 18A. The fabric element path further comprises a fourth segment that is consecutive and at least partially transversal to the third segment, and a fifth segment that is consecutive and at least partially transversal to the fourth segment. The third segment, the fourth segment and the fifth segment define a fabric element path basically shaped as a "U" on the second operating area. The fifth segment is placed beside the second side 18A" of the base 18A and the third segment is at a greater distance from the second side 18A" of the base 18A than a distance of the fifth segment from the second side 18A" of the base 18A. The fabric element path may further comprise a sixth segment that is consecutive to the fifth segment; optionally, the sixth segment is at least partially transversal to the fifth segment. As for the slide 16 moving the fabric element 201, the first take-up device 7 and the second take-up device 9 follow, under the control and supervision of the control unit, respective paths configured so as to move the first tubular fabric 100 along the fabric element path defined by the slide 16; these paths defined by the take-up devices 7, 9 basically describe the path of the first tubular fabric 100 around the base 18A of the sewing machine 18.

In operating conditions, the slide 16 moves the fabric element 201 along the first segment parallel to the first side 18A' of the base 18A; during this movement, the grippers 7A, 7B of the first take-up device 7 move the first edge portion 101 along a respective segment of their path on the first operating area, and the grippers 9A, 9B of the second take-up device 9 move the second edge portion 102 along a respective segment of their path on the second operating area (see FIG. 8). The fabric element 201 is blocked by the blocking plate 16A of the slide 16 so that the second longitudinal edge 201B is moved, when the slide 16 moves forward along the first segment, on the second operating area. When the first piece 105A of the middle segment 102A of the second edge portion 101 is sewn, the first gripper 9A of the second take-up device 9 carrying the first piece 105A, the first gripper 9A of the second take-up device 9 is not aligned with the second gripper 9B. The first gripper 9A is displaced angularly of 90° with respect to the second gripper 9B, oriented with respect to the latter in a basically "L"-shaped arrangement and placed in front of the sewing head 18B and moves close to the latter. After sewing the first piece 105A of the second edge portion 102 of the first tubular fabric 100 to a portion of the second longitudinal edge 201B of the fabric element 201, the forward movement of the slide 16 stops for a moment, the first gripper 9A rotates on a lying plane of the grippers 9A, 9B making a 90° rotation on the plane so as to be aligned with the second gripper 9B of the second take-up device 9; in an alternative embodiment, the grippers 9A, 9B can be displaced in a reversed direction and moved in the opposed direction, i.e. the second gripper 9B is moved with respect to the first gripper 9A. Now the slide 16 resumes its forward movement and the sewing head 18B sews the second piece 105B of the first edge portion 101 to a respective portion of the first longitudinal edge 201A of the fabric element 201 so as to complete the first seam BS1. This combined movement of the grippers 7A, 7B of the first take-up device 7 and of the slide 16 is controlled and driven by the control unit and allows each piece 105A, 105B of the second edge portion 102 to be sewn in an optimal manner to the second longitudinal edge 201B of the fabric element 201. When the first seam BS1 is completed, i.e. when the slide 16 has gone over the first segment, the grippers 9A, 9B of the second take-up device 9 switch from the closed position in which they retain the second edge portion 102, to the open position, so as to disengage the second edge portion 102 from the grippers 9A, 9B. After creating the first seam BS1, the fabric element 201 is integral with the first tubular fabric 100 and the movement of the first tubular fabric 100 takes place by means of the grippers 7A, 7B of the first take-up device 7, which remain in the closed position in which they catch and carry the first edge portion 101 of the first tubular fabric 100. The slide 16 then moves the fabric element 201 along the second segment of the path so as to rotate around the base 18A and then along the third segment of the path, where the fabric element 201 shifts parallel to the second side 18A" of the base 18A; FIG. 9 shows an arrow indicating the movement of the slide 16 and then of the fabric element 201 from the second segment to the first segment. After going over the third segment, the slide 16 then moves the fabric element 201 along the fourth segment getting close to the sewing head 18B. Then the slide 16 moves the fabric element 201 along the fifth segment of the fabric path element parallel to the second side 18A" of the base 18A and at the same time the grippers 7A, 7B of the first take-up device 7 carry the first tubular fabric 100; during this movement, shown in FIG. 10, the sewing head 18B sews the first longitudinal edge 201A of the fabric element 201 to the middle segment 101A of the first edge portion 101 of the first end 100A of the tubular fabric 100. When the first piece 104A of the middle segment 101A of the first edge portion 101 is sewn, the first gripper 7A of the first take-up device 7 carrying the first piece 104A, the first gripper 7A of the first take-up device 7 is not aligned with the first gripper 7A. The second gripper 7B is displaced angularly of 90° with respect to the first gripper 7A, oriented with respect to the latter in a basically "L"-shaped arrangement and placed in front of the sewing head 18B and moves close to the latter. After sewing the first piece 104A of the first edge portion 101 to a portion of the first longitudinal edge 201A of the fabric element 201, the forward movement of the slide 16 stops for a moment, the first gripper 7A rotates on a lying plane of the grippers 7A, 7B making a 90° rotation on the plane so as to be aligned with the first gripper 7A of the first take-up device 7; in an alternative embodiment, the grippers 7A, 7B can be displaced in a reversed direction and moved in the opposed direction, i.e. the second gripper 7B is moved with respect to the first gripper 7A. Now the slide 16 resumes its forward movement along the fifth segment of the path and the sewing head 18B creates the second seam BS2 sewing the second piece 104B of the first edge portion 101 to a respective portion of the first longitudinal edge 201A of the fabric element 201. This combined movement of the grippers 7A, 7B of the first take-up device 7 and of the slide 16 is controlled and driven by the control unit and allows each piece 104A, 104B of the first edge portion 101 to be sewn in an optimal manner to the first longitudinal edge 201A of the fabric element 201.

Figure 11A:
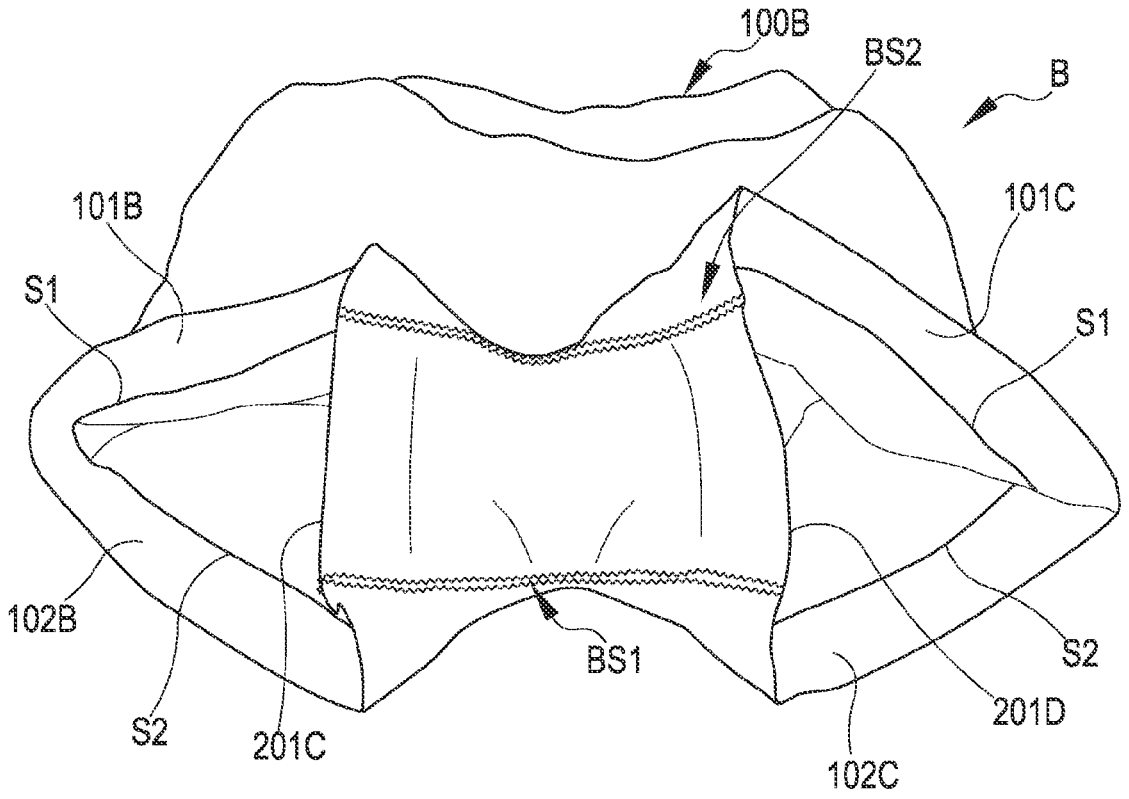
FIG. 11A is a perspective view of a pair of boxers manufactured with the machine of FIG. 1.
Figure 11B:
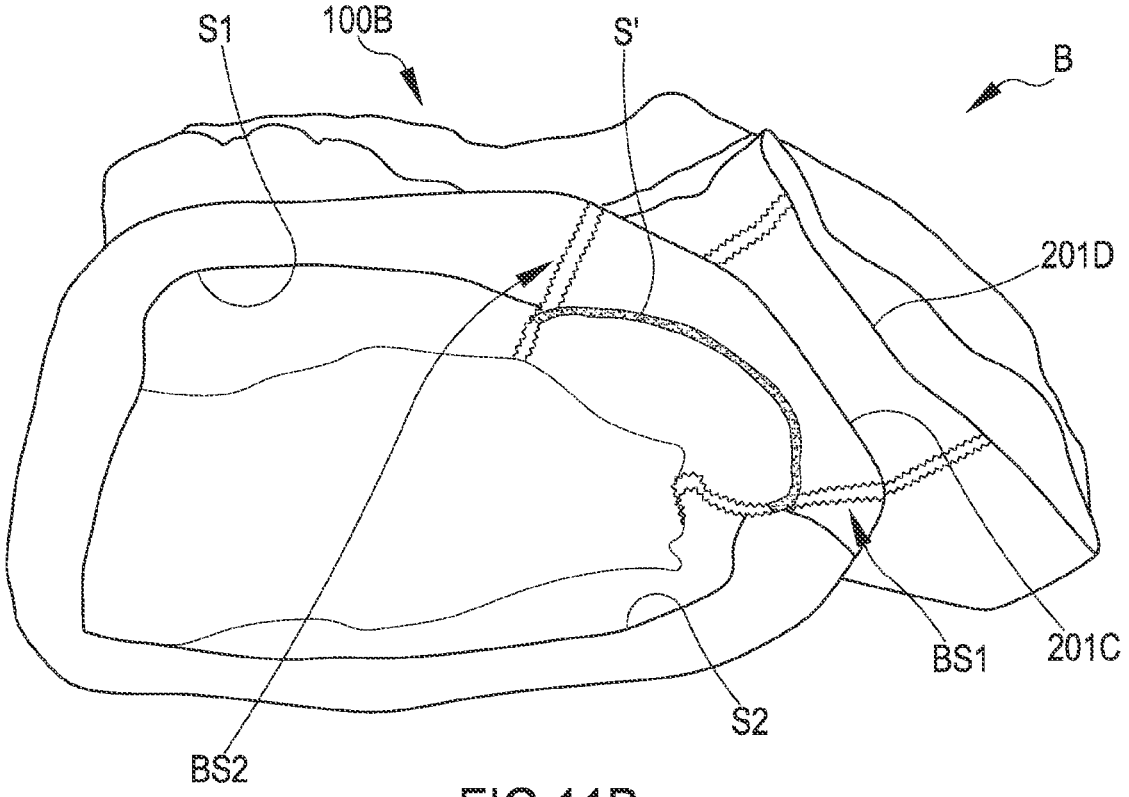
FIG. 11B is a detailed view showing the inner surface of a hollow portion of the pair of boxers of FIG. 11A, designed to act as a guide for a lower limb of a user of the pair of boxers, on which the continuity and basically circumferential alignment of the inner seams of the fabric element and of the inner seams of the first tubular fabric are well visible.

Once the seams BS1, BS2 are completed, the finished item is the pair of boxers B as shown in FIGS. 11A and 11B, in which the fabric element 201 is integral with the first tubular fabric 100 exactly because of the seams BS1, BS2. In the pair of boxers B the transversal edges 201C, 201D of the fabric element 201 delimit, together with the respective adjacent end segments 101B, 101C, 102B, 102C of the first tubular fabric 100, respective hollow portions of the pair of boxers designed to act as a guide for the lower limbs of a user of the pair of boxers. A detail of a hollow portion of the pair of boxers B is shown in FIG. 11B, showing the continuity and basically circumferential alignment of the inner seams S' of the fabric element 201 and of the inner seams S1, S2 of the first tubular fabric 100 to be obtained according to the invention. In the finished pair of boxers, the second end 100B of the tubular fabric 100 develops on the opposed side with respect to the hollow portions; it can be elastic and is designed to surround, in conditions of use of the pair of boxers B, the user's torso.

The machine 1 can further comprise an unloading station configured for allowing unloading of the pair of boxers B manufactured according to the above description. The unloading station is arranged downstream from the sewing station 17 and the slide 16 can be configured for moving, in operating conditions of the machine 1, the pair of boxers B along the sixth segment of the fabric element path, which connects the fifth segment to the unloading station.

The machine 1 described above allows to implement and automate a method for manufacturing boxers B, as described hereinafter.

Method

It is a further object of the present invention a method for manufacturing boxers B. The method can be performed in an automated manner by means of the machine 1 according to the description above, with one or more of the previous aspects and, in addition or as an alternative, according to any one of the appended claims. The control unit can be designed to control and drive each of the steps described below or of the operations described above in relation to the machine 1. Moreover, the method can include steps, actions and operations described above referring to the machine 1. The means used for implementing the steps that shall be described hereinafter can be the stations, devices, elements, components described above referring to the machine 1.

The method includes providing a first tubular fabric 100 or a stack of first tubular fabric 100 of the type as described above, and a second tubular fabric 200 or a stack of second tubular fabrics 200 of the type as described above.

The method can include creating the first cut or vent 104 and the second cut or vent 105 on the first edge portion 101 and on the second edge portion 102, respectively, of the first end 100A of the tubular fabric 100, e.g. by means of the cutting station 12, thanks to the spreading station 5 and in accordance with the modes described above (spreading the first tubular fabric 100, positioning the first tubular fabric 100, creating the cuts or vents 104, 105, etc.). As an alternative to the creation of cuts or vents 104, 105, the method can include providing at least a first tubular fabric 100 provided with a cut or vent 104, 105, e.g. created before it has been loaded into the machine 1, on one of the first edge portion and the second edge portion 101, 102, and creating a cut or vent 104, 105 only on the other one of the first edge portion 101 and the second edge portion 102. In a further embodiment, the method can include providing first tubular fabrics 100, pre-cut or pre-vented and already provided with both cuts or vents 104, 105 when arranged; in this embodiment, these cuts or vents 104, 105 are made before the first tubular fabric 100 are loaded into the machine 1. The preferred embodiment of the invention involves creating both cuts or vents 104, 105 e.g. by means of the cutting station 12.

After the cutting steps for creating the cuts or vents 104, 105, the method further includes placing the first edge portion 101 and the second edge portion 102 so as to define between them an intermediate operating area 103; this step can be executed by suitably moving the first take-up device 7 and the second take-up device 9, which catch the first edge portion 101 and the second edge portion 102 according to the modes described above. In particular, as previously described in detail referring to the handling station 6, the intermediate operating area 103 can be defined at the first height, by tilting the second take-up device 9 with respect to the first take-up device 7.

The method includes separating at least one fabric element 201, e.g. by means of the separating station 15 for at least one fabric element 201 from the second tubular fabric 200, as described above and according to the modes previously detailed (spreading the second tubular fabric 200, blocking the second tubular fabric 200, at least one cutting operation, etc.). As an alternative to providing the second tubular portion 200 and to separating at least one fabric element 201 from the latter, the method may include providing at least one fabric element 201 or a stack of fabric elements 201. The first tubular fabrics 200 and the second tubular fabric 200 or the fabric elements 201 can be provided on the first loading station 3 and on the second loading station 13, respectively, as described above and in accordance with the modes previously detailed. The preferred embodiment of the invention includes providing second tubular fabrics 200, from which fabric elements 201 are separated by means of the separating station 15.

After separating the fabric element 201 from the second tubular fabric 200, the method includes placing the fabric element 201 on the intermediate operating area 103 so that the first longitudinal edge 201A of the fabric element 201 and the middle segment 101A of the first edge portion 101 at least partially overlap or face each other, and a second longitudinal edge 201B of the fabric element 201, opposed to the first longitudinal edge 201A, and the middle segment 102A of the second edge portion 102 at least partially overlap or face each other. The step of placing the fabric element 201 on the intermediate operating area 103 is preferably performed by placing the first tubular fabric with the cuts or vents 104, 105 around the fabric element 201; this operation is performed by moving the first take-up device 7 and the second take-up device 9 close to the moving device 12 blocking the fabric element 201. In other words, according to this embodiment the fabric element 201 and the moving device 12 are still and the first tubular fabric 100 moves by means of the take-up devices 7, 9. As an alternative, the step of placing the fabric element 201 on the intermediate operating area 103 can be performed by moving the moving device 12 close to the first tubular fabric 100 so as to insert the fabric element 201 into the intermediate operating area; in other words, according to this embodiment the take-up devices 7, 9 and the first tubular fabric 100 are still and it is the fabric element 201 that moves by means of the moving device 12. In a variant, both the first tubular fabric is moved by means of the take-up device 7, 9 and the fabric element 201 is moved by means of the moving device 12.

The method then includes sewing the second longitudinal edge 201B of the fabric element 201 to the second cut or vent 105 defined on the middle segment 102A of the second edge portion 102 of the first end 100A of the first tubular fabric 100, so as to make the fabric element 201 integral with the tubular fabric 100, e.g. by means of the sewing station 17 and according to the modes described above. This sewing step creates the first seam BS1.

The method further includes sewing the first longitudinal edge 201A of the fabric element 201 to the first cut or vent 104 defined on the middle segment 101A of the first edge portion 101 of the first end 100A of the first tubular fabric 100, e.g. by means of the sewing station 17 and according to the modes described above. This sewing step creates the second seam BS2.

In an alternative embodiment, the first longitudinal edge 201A of the fabric element 201 can be sewn to the first cut or vent 104 in advance with respect to the second longitudinal edge 201B of the fabric element 201 being sewn to the second cut or vent 105.

At the end of the method, a pair of boxers B as described above and shown in FIGS. 11A and 11B is obtained.

Advantages of the Invention

The present invention allows to obtain a machine 1 that is able to manufacture boxers B in an automated manner.

The machine 1 according to the invention further allows to manufacture boxers B in a fast, repeatable and therefore reliable manner; thus the machine 1 is highly efficient and is able to manufacture a large amount of boxers B per time unit, e.g. per hour.

Moreover, the machine 1 according to the invention eliminates the need for manual interventions of the operations when manufacturing boxers B; the production of boxers B with the machine 1 according to the invention therefore does not depend on the expertise or experience of single operators. In other words, thanks to the automation the machine 1 ensures a repeatable and constant quality of boxers in time.

The machine 1 according to the invention is advantageously able to manufacture without interruptions a series of boxers B in sequence. The machine 1 according to the invention therefore has a high productivity in terms of number of boxers B manufactured per time unit, e.g. per hour.

Moreover, the machine 1 according to the invention is able to perform at least two production cycles at the same time, which differ for the position of the fabric elements 201, each being designed to manufacture a respective pair of boxers B, along the machine 1. This allows to increase the productivity of the machine 1, e.g. in terms of number of boxers manufactured per time unit, e.g. per hour. Advantageously, the presence of a control unit makes it easier to automate the machine 1 since the control unit controls the operation of the machine 1 managing, driving and monitoring the operation of the stations, elements and devices of the machine 1 as described above.

The machine 1 according to the invention further allow to reduce the manufacturing costs for the boxers B. The machine 1 according to the invention further has an advantageous arrangement of stations and devices as described above; this feature allows to obtain a compact machine 1 with a small overall size.

The machine 1 according to the invention advantageously allows to manufacture boxers B optimizing the management of incoming fabrics; in particular, the modes for separating fabric elements 201 from the second tubular fabric 200 as described above allow the machine to minimize the amount of scraps.

The invention further provides an efficient and fast method for manufacturing boxers B, which can be effectively and easily automated with the machine 1 according to the invention. The method according to the invention is advantageously simple, efficient and rational.

Obviously, the advantages previously described with reference to the machine 1, can be applied mutatis mutandis to the method.

The machine 1 and the method according to the invention therefore allow to manufacture boxers B with a high and repeatable quality, which are comfortable for users. The boxers B manufactured according to the invention are characterized by the continuity and basically circumferential alignment of the seams S' developing on the inner surface of the fabric element 201, and of the seams S1, S2 developing on the inner surface of the first tubular fabric 100.

The invention claimed is:

1. A machine (1) for manufacturing men's underwear, the machine (1) comprising:

a first loading station (3) configured for allowing loading of at least one tubular fabric (100) or a stack of tubular fabrics (100), the tubular fabric (100) having a first end (100A) and a second end (100B) opposed to one another, between which a fabric coat delimiting a tubular duct develops, each end (100A, 100B) exhibiting an edge delimiting a hollow access port apt to enable access to the tubular duct, the edge of the first end (100A) comprising a first edge portion (101) and a second edge portion (102) that are adjacent to one another and cooperate so as to delimit the hollow access port of the first end (100A), the first edge portion (101) and the second edge portion (102) comprising a respective middle segment (101A, 102A) destined to be sewn, and respective end segments (101B, 101C, 102B, 102C) opposed to the respective middle segment (101A, 102A), a handling station (6) configured for handling the tubular fabric (100), the handling station (6) comprising:

at least a first take-up (7) device (100) configured for catching the tubular fabric at said first edge portion (101) and handling said first edge portion (101), at least a second take-up device (9) configured for catching the tubular fabric (100) at said second edge portion (102) and handling said second edge portion (102), the handling station (6) being configured for defining an operating configuration in which the first take-up device (7) and the second take-up device (9) define between them an intermediate operating area (103), a second loading station (13) configured for allowing loading of at least one fabric element (201), a moving device (16) configured for moving a fabric element (201), downstream from the second loading station (13), as far as the handling station (6) and configured for placing the fabric element (201) in an operating position, defined at said intermediate operating area (103), in which a first longitudinal edge (201A) of the fabric element (201) and the middle segment (101A) of said first edge portion (101) at least partially overlap or face each other, and a second longitudinal edge (201B) of the fabric element (201), opposed to said longitudinal edge (201A), and the middle segment (102A) of said second edge portion (102) at least partially overlap or face each other, a sewing station (17) configured for receiving the incoming tubular fabric (100) and the fabric element (201) arranged with respect to the tubular fabric (100) in said operating position, said sewing station (17) being configured for sewing the first longitudinal edge (201A) of the fabric element (201) to the middle segment (101A) of the first edge portion (101) of the first end (100A) of the tubular fabric (100) and being further configured for sewing the second longitudinal edge (201B) of the fabric element (201) to the middle segment (102A) of the second edge portion (102) of the first end (100A) of the tubular fabric (100) so as to make the fabric element (201) integral with the tubular fabric (100).

2. The machine according to claim 1, wherein at least one of the first take-up device (7) and the second take-up device (9) is configured for operating between a catching position in which it can catch the respective edge portion (101, 102) and an operating position in which it defined, together with the other one of the first take-up device (7) and the second take-up device (9), said intermediate operating area (103), said at least one of the first take-up device (7) and the second take-up device (9) being movable with respect to the other one of the first take-up device (7) and the second take-up device (9) so as to switch from the catching position to the operating position.

3. The machine according to claim 2, wherein the handling station (6) is configured for further defining, before said operating configuration, a catching configuration in which the first take-up device (7) and the second take-up device (9) take respective operating positions in which they catch the first edge portion (101) and the second edge portion (102), respectively, in said catching configuration the first edge portion (101) being at a first height and the second edge portion (102) being below the first edge portion (101) at a second height that is lower than the first height, the second take-up device (9) being configured for rotating with respect to the first take-up device (7) so as to shift from the catching position to the operating position in order to shift the second edge portion (102) to the first height at which the second edge portion (102) takes a pre-established operating position in which it faces the first edge portion (101).

4. The machine according to claim 1, further comprising a cutting station (12) configured for creating a first cut or vent (104) on the tubular fabric (100) on the middle segment (101A) of said first edge portion (101), and a second cut or vent (105) on the tubular fabric (100) on said middle segment (102A) of said second edge portion (102), each cut or vent (104, 105) defining a first piece (104A, 105A) and a second piece (104B, 105B) on the respective middle segment (101A, 102A).

5. The machine according to claim 4, wherein the cutting station (12) comprises a cutting element (12A) or a pair of scissors or a blade, the machine further comprising a control unit operatively connected to the first take-up device (7), to the second take-up device (9) and to the cutting element (12A), and configured for:

driving the first take-up device (7) to catch the tubular fabric (100) at said first edge portion (101), driving the second take-up device (9) to catch the tubular fabric (100) at said second edge portion (102), after the first take-up device (7) has caught the tubular fabric (100), driving the cutting element (12A) to create the first cut or vent (104) on the tubular fabric (100) in the middle segment (101A) of said first edge portion (101), e.g. at a first point in time, and after the second take-up device (9) has caught the tubular fabric (100), driving the cutting element (12A) to create the second cut or vent (105) on the tubular fabric (100) in the middle segment (102A) of said second edge portion (102), e.g. at a second point in time.

6. The machine according to claim 5, further comprising managing a time sequence for creating the first cut or vent (104) and the second cut or vent (105), according to which the second point in time is after the first point in time.

7. The machine according to claim 4, further comprising a spreading station (5) configured for spreading, in operating conditions of the machine (1), at least partially the tubular fabric (100) so as to stretch and/or tension it, the spreading station (5) being arranged, with reference to a forward path of the tubular fabric (100) in the machine (1), downwards from the first loading station (3) and upwards from the cutting station (12).

8. The machine according to claim 7, wherein the spreading station (5) comprises two spreading bars (5A) configured for being distanced and approached one to the other and further configured for being introduced, in operating conditions of the machine (1), into the tubular duct of the tubular fabric (100) and for being removed from the tubular duct, the machine (1) further comprising a first pick-up station (4) configured for picking up at least one tubular fabric (100) from the first loading station (3), and a control unit operatively connected to the first take-up device (7), to the second take-up device (9) and to the spreading bars (5A) and configured for:

after the first pick-up device (4) has picked up the tubular fabric (100), introducing at least partially the spreading bars (5A) into the tubular duct, spreading the spreading bars (5A) so as to stretch and/or tension the tubular fabric (100), driving the first take-up device (7) and the second take-up device (9) so that they catch the first edge portion (101) and the second edge portion (102), respectively, of the tubular fabric (100), after the first cut or vent (104) has been created on the first edge portion (101) and the second cut or vent (105) has been created on the second edge portion (102), removing the spreading bars (5A) from the tubular duct so as to disengage them from the tubular fabric (100).

9. The machine according to claim 7, wherein the machine (1) comprises a frame (2), the spreading station (5) being movable engaged to the frame (2) so as to be able to slide to and from the cutting station (12).

10. The machine according to claim 1, wherein the tubular fabric (100) is a pre-cut or pre-vented tubular fabric having at least one of a first cut or vent (104) on the middle segment (101A) of said first edge portion (101), and a second cut or vent (105) on the middle segment (102A) of said second edge portion (102), each cut or vent (104, 105) defining a first piece (104A, 105A) and a second piece (104B, 105B) on the respective middle segment (101A, 102A), the first loading station (3) being configured for allowing loading of at least one pre-cut or pre-vented tubular fabric (100), or of a stack of pre-cut or pre-vented tubular fabrics (100), and the first take-up device (7) being configured for catching the first piece (104A) and the second piece (104B) of said first edge portion (101), and the second take-up device (9) being configured for catching the first piece (105A) and the second piece (105B) of said second edge portion (102).

11. The method according to claim 1, wherein the second loading station (13) is configured for allowing loading of a further tubular fabric (200) or of a stack of further tubular fabrics (200), wherein said at least one fabric element (201) is separated from said further tubular fabric (200), the machine (1) further comprising a separating station (15) arranged downstream from the second loading station (13), the separating station (15) being configured for separating, by means of one or more cutting operations, at least one fabric element (201) from the further tubular fabric (200).

12. The machine according to claim 11, wherein the tubular fabric (100) and the fabric element (201) or the further tubular fabric (200) are made of the same fabric and/or are manufactured using the same type of knitting machine and/or by means of the same circular knitting machine for knitted or hosiery items.

13. The machine according to claim 1, wherein the sewing station (17) comprises a sewing machine (18) comprising:

a base (18A) equipped with a first side (18A') and with a second side (18A") opposed one to the other, the base (18A) defining a first operating area and a second operating area that are opposed to the sides (18A', 18A") of the base (18A), a sewing head (18B) configured for sewing on a first sewing area that is close and beside the first operating area, and configured for further sewing on a second sewing area that is close and beside the second operating area, the machine (1) further comprising a frame (2) and at least one moving mechanism (8, 10, 11) acting upon the handling station (6), said at least one moving mechanism (8, 10, 11) being configured for moving at least partially the handling station (6) with respect to the frame (2) so as to push, in operating conditions of the machine (1), the first take-up device (7) and/or the second take-up device (9) and thus the tubular fabric (100), along a forward path of the tubular fabric (100) through the machine (1), the machine further comprising a control unit operatively connected to said at least one moving mechanism (8, 10, 11) and to the moving device (16), and configured for:

driving said at least one moving mechanism (8, 10, 11) to move the first take-up device (7) and/or the second take-up device (9) in a sequence of operating positions defined around the base (18A) of the sewing machine (18) so as to move, in operating conditions of the machine (1), said tubular fabric (100) in a sequence of operating positions defined around the base (18A) of the sewing machine (18), driving the moving device (16) to move, in operating conditions of the machine (1), said fabric element (201) in a sequence of operating positions defined around the base (18A) of the sewing machine (18), managing the movement of the tubular fabric (100) and of the fabric element (201) according to a positioning relation between the sequence of operating positions of the first take-up device (7) and/or of the second take-up device (9) and the sequence of operating positions of the moving device (16), said positioning relation being to allow the sewing machine (1) to sew the first longitudinal edge (201A) of the fabric element (201) to the first edge portion (101) of the first end (100A) of the tubular fabric (100) and the second longitudinal edge (201B) of the fabric element (201) to the second edge portion (102) of the first end (100A) of the tubular fabric (100), driving the sewing machine (1) to sew, on one of the first sewing area and the second sewing area, the first longitudinal edge (201A) of the fabric element (201) to the first piece (104A) and to the second piece (104B) of the middle segment (101A) of the first edge portion (101) of the first end (100A) of the tubular fabric (100), and to sew, on the other one of the first sewing area and the second sewing area, the second longitudinal edge (201B) of the fabric element (201) to the first piece (105A) and to the second piece (105B) of the middle segment (102A) of the second edge portion (102) of the first end (100A) of the tubular fabric (100).

14. The machine according to claim 13, wherein the first longitudinal edge (201A) of the fabric element (201) being sewn to the first piece (104A) and to the second piece (104B) of the middle segment (101A) of the first edge portion (101) of the first end (100A) of the tubular fabric (100), and the second longitudinal edge (201B) of the fabric element (201) being sewn to the first piece (105A) and to the second piece (105B) of the middle segment (102A) of the second edge portion (102) of the first end (100A) of the tubular fabric (100), on respective sewing lines that are basically rectilinear and/or parallel.

15. A method for manufacturing men's underwear, comprising at least the following steps:

providing a tubular fabric (100) having a first end (100A) and a second end (100B) opposed to one another, between which a fabric coat delimiting a tubular duct develops, each end (100A, 100B) exhibiting an edge delimiting a hollow access port apt to enable access to the tubular duct, the edge of the first end (100A) comprising a first edge portion (101) and a second edge portion (102) that are adjacent to one another and cooperate so as to delimit the hollow access port of the first end, the first edge portion (101) and the second edge portion (102) comprising a respective middle segment (101A, 102A) destined to be sewn, and respective end segments (101B, 101C, 102B, 102C) opposed to the respective middle segment (101A, 102A), arranging the first edge portion (101) and the second edge portion (102) so as to define between them an intermediate area (103), providing a fabric element (201), placing the fabric element (201) on said intermediate operating area (103) so that a first longitudinal edge (201A) of the fabric element (201) and the middle segment (101A) of said first edge portion (101) at least partially overlap or face each other, and a second longitudinal edge (201B) of the fabric element (201), opposed to said longitudinal edge (201A), and the middle segment (102A) of said second edge portion (102) at least partially overlap or face each other, sewing the first longitudinal edge (201A) of the fabric element (100) to the middle segment (101A) of the first edge portion (101) of the first end (100A) of the tubular fabric (100), sewing the second longitudinal edge of the fabric element to the middle segment of the second edge portion of the first end of the tubular fabric so as to make the fabric element (201) integral with the tubular fabric (100);

wherein the method is performed in a machine according to claim 1.

* * * * *